US011946397B1

(12) United States Patent
Lawrence et al.

(10) Patent No.: US 11,946,397 B1
(45) Date of Patent: Apr. 2, 2024

(54) PRE-HEATED CRANKCASE VENTILATION SYSTEM ARCHITECTURE

(71) Applicant: Caterpillar Inc., Peoria, IL (US)

(72) Inventors: Rodney Allen Lawrence, Frankfort, IN (US); Brandyn A. Stack, Lafayette, IN (US); Joshua Amiel Lehe, West Lafayette, IN (US); Nicholas Edwin Wainscott, Rossville, IN (US); Eric John Forthofer, Frankfort, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/141,579

(22) Filed: May 1, 2023

(51) Int. Cl.

| | |
|---|---|
| ***F01M 5/00*** | (2006.01) |
| ***F01M 5/02*** | (2006.01) |
| ***F01M 11/00*** | (2006.01) |
| ***F01M 13/02*** | (2006.01) |
| ***F01M 13/04*** | (2006.01) |

(52) U.S. Cl.
CPC ..... *F01M 5/005* (2013.01); *F01M 5/021* (2013.01); *F01M 11/0004* (2013.01); *F01M 13/021* (2013.01); *F01M 13/04* (2013.01); *F01M 2013/026* (2013.01); *F01M 2013/0438* (2013.01)

(58) Field of Classification Search
CPC .... F01M 5/005; F01M 5/021; F01M 11/0004; F01M 13/021; F01M 13/04; F01M 2013/026; F01M 2013/0438
See application file for complete search history.

(56) References Cited

U.S. PATENT DOCUMENTS

| | | | | |
|---|---|---|---|---|
| 4,768,493 | A | 9/1988 | Ohtaka et al. | |
| 5,937,837 | A * | 8/1999 | Shaffer | F01M 5/002 123/573 |
| 6,234,154 | B1 | 5/2001 | Spix | |
| 9,702,282 | B2 | 7/2017 | Peck et al. | |
| 10,184,444 | B2 | 1/2019 | Plenk | |
| 10,550,742 | B2 | 2/2020 | Zuerker et al. | |
| 10,704,434 | B2 | 7/2020 | Akita et al. | |
| 2009/0199794 | A1 * | 8/2009 | Slaughter | F01M 13/04 123/41.86 |
| 2010/0051388 | A1 * | 3/2010 | Clark | B01D 46/30 184/6.24 |
| 2019/0218947 | A1 * | 7/2019 | Akita | F01M 5/00 |
| 2023/0313750 | A1 * | 10/2023 | Li | F02D 41/0052 123/41.86 |

FOREIGN PATENT DOCUMENTS

| | | |
|---|---|---|
| DE | 10310452 | 8/2008 |
| EP | 1965045 | 12/2012 |

* cited by examiner

*Primary Examiner* — Grant Moubry
(74) *Attorney, Agent, or Firm* — Schwegman Lundberg & Woessner, P.A.

(57) ABSTRACT

An engine system optionally including: a crankcase of an engine having a blow-by gas passing therethrough; a liquid source containing a liquid; and an oil separating apparatus in fluid communication with the blow-by gas. The oil separating apparatus having a coalescing filter to separate oil from the blow-by gas. Separate from the blow-by gas and the coalescing filter, the oil separating apparatus is in fluid communication with the liquid source to receive the liquid. The liquid is passed through the oil separating apparatus in a heat exchange relationship with the blow-by gas to maintain a desired temperature range for the blow-by gas.

20 Claims, 11 Drawing Sheets

PRE-HEATED CRANKCASE VENTILATION SYSTEM ARCHITECTURE

TECHNICAL FIELD

The present disclosure relates to internal combustion engines such as those for vehicles or stationary power generation. More particularly, the present disclosure relates to internal combustion engines having crankcase ventilation systems.

BACKGROUND

Machinery, for example, agricultural, industrial, construction or other heavy machinery can be propelled by an internal combustion engine(s). Internal combustion engines can be used for other purposes such as for power generation. Internal combustion engines combust a mixture of air and fuel in cylinders and thereby produce drive torque and power. A portion of the combustion gases (termed "blow-by") may escape the combustion chamber past the piston and enter undesirable areas of the engine such as the crankcase. Blow-by can contain un-combusted fuel, oil and explosive gases. In rare cases, un-combusted fuel and/or explosive gases can build within the engine such as within the crankcase. The un-combusted fuel and/or explosive gases can result in an explosion if not properly mitigated such as by a relief valve. Crankcase ventilation systems are known in combustion engines to vent, capture or dilute blow-by gases of the crankcase. Such ventilation systems can include oil separation devices as part of such systems. For example, U.S. Pat. Nos. 9,702,282B2, 10,184,444B2 and 10,550,742B2 disclose examples of an oil separation device that is part of crankcase ventilation system. However, U.S. Pat. Nos. 10,550,742B2, 10,184,444B2 and 9,702,282B2 do not utilize a jacket to insulate, cool or heat a coalescing filter in a desired manner. The '742 Patent discloses an arrangement of devices that employ parallel inlet and outlet channels for blow-by gas.

SUMMARY

In one example an engine system is disclosed, the engine system optionally including: a crankcase of an engine having a blow-by gas passing therethrough; a liquid source containing a liquid; and an oil separating apparatus in fluid communication with the blow-by gas. The oil separating apparatus having a coalescing filter to separate oil from the blow-by gas. Separate from the blow-by gas and the coalescing filter, the oil separating apparatus is in fluid communication with the liquid source to receive the liquid. The liquid is passed through the oil separating apparatus in a heat exchange relationship with the blow-by gas to maintain a desired temperature range for the blow-by gas.

In another example a method of maintaining blow-by gas from a crankcase of an engine within a desired temperature range when passing through an oil separating apparatus is disclosed, the method optionally including: passing the blow-by gas from the crankcase to the oil separating apparatus; supplying a liquid from a liquid source through the oil separating apparatus, within the oil separating apparatus the liquid is in a heat transfer relationship with the blow-by gas passing through the oil separating apparatus and maintains the blow-by gas at a desired temperature range; separating oil from the blow-by gas with the oil separating apparatus; passing the oil separated by the oil separating apparatus to the crankcase; and returning the liquid to the liquid source.

In yet another example an engine is disclosed, the engine optionally including: a crankcase having a blow-by gas passing therethrough; an on engine liquid source containing one of engine coolant or engine lube oil heated prior to startup of the engine to a first desired temperature range; and an oil separating apparatus in fluid communication with the blow-by gas and having a coalescing filter to separate oil from the blow-by gas. Separate from the blow-by gas and the coalescing filter, the oil separating apparatus is in fluid communication with the liquid source to receive the one of engine coolant or engine lube oil. The one of engine coolant or engine lube oil is passed through the oil separating apparatus in a heat exchange relationship with the blow-by gas to maintain a second desired temperature range for the blow-by gas.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Examples according to this disclosure are directed to an oil separation device(s) for internal combustion engines, and to systems and methods for filtering oil to separate oil and other forms of particulate matter from blow-by gas. Examples of the present disclosure are now described with reference to the accompanying drawings. The following description is merely exemplary in nature and is not intended to limit the present disclosure, application, or use. Examples described set forth specific components, devices, and methods, to provide an understanding of embodiments of the present disclosure. It will be apparent to those skilled in the art that specific details need not be employed and that examples may be embodied in many different forms. Thus, the examples provided should not be construed to limit the scope of the claims.

Figure 1A:
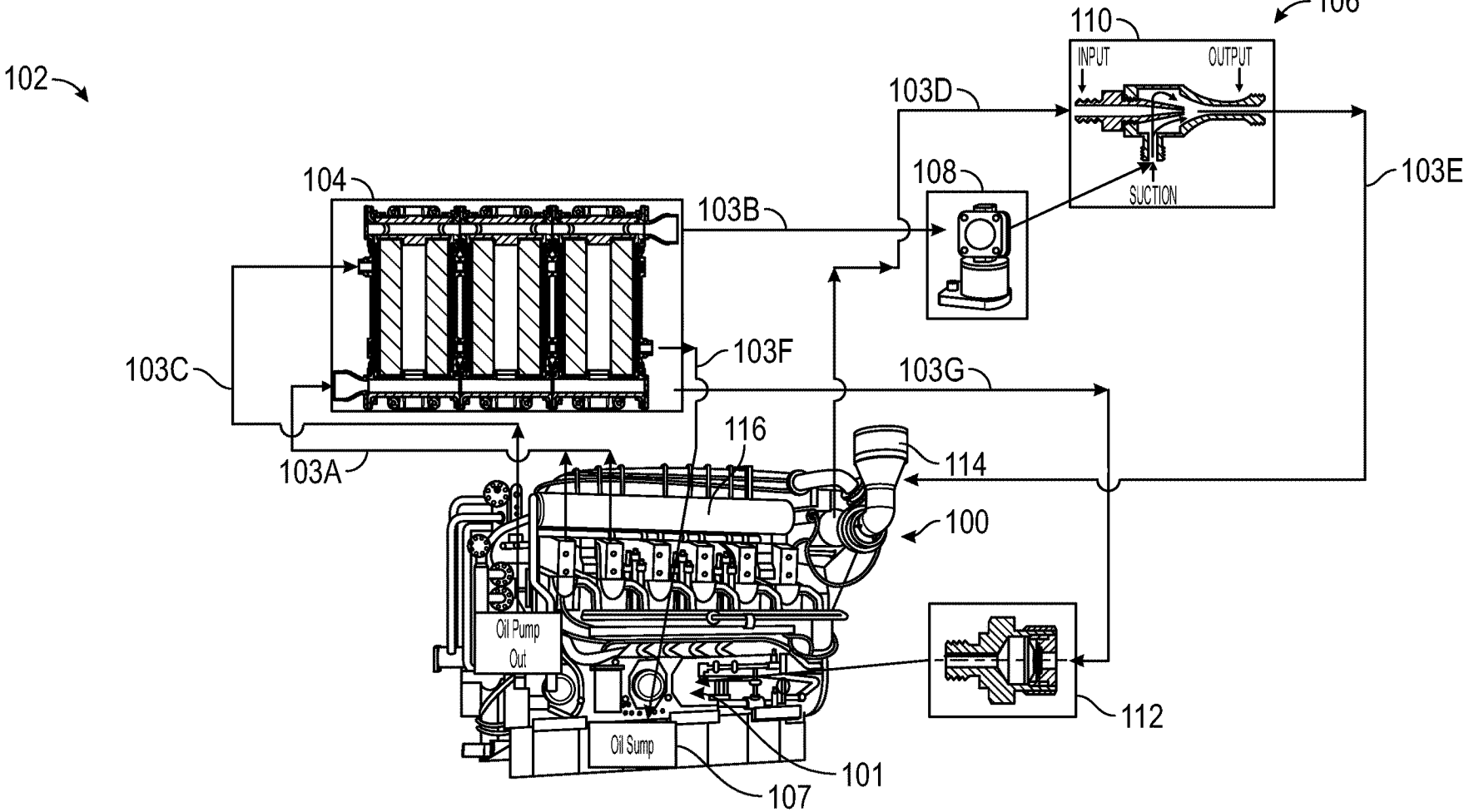
FIG. 1A is a schematic illustration depicting a first example of an engine system including a blow-by gas oil separation device with components maintained at a desired temperature range using lube oil in accordance with an example of the present application.
Figure 1B:
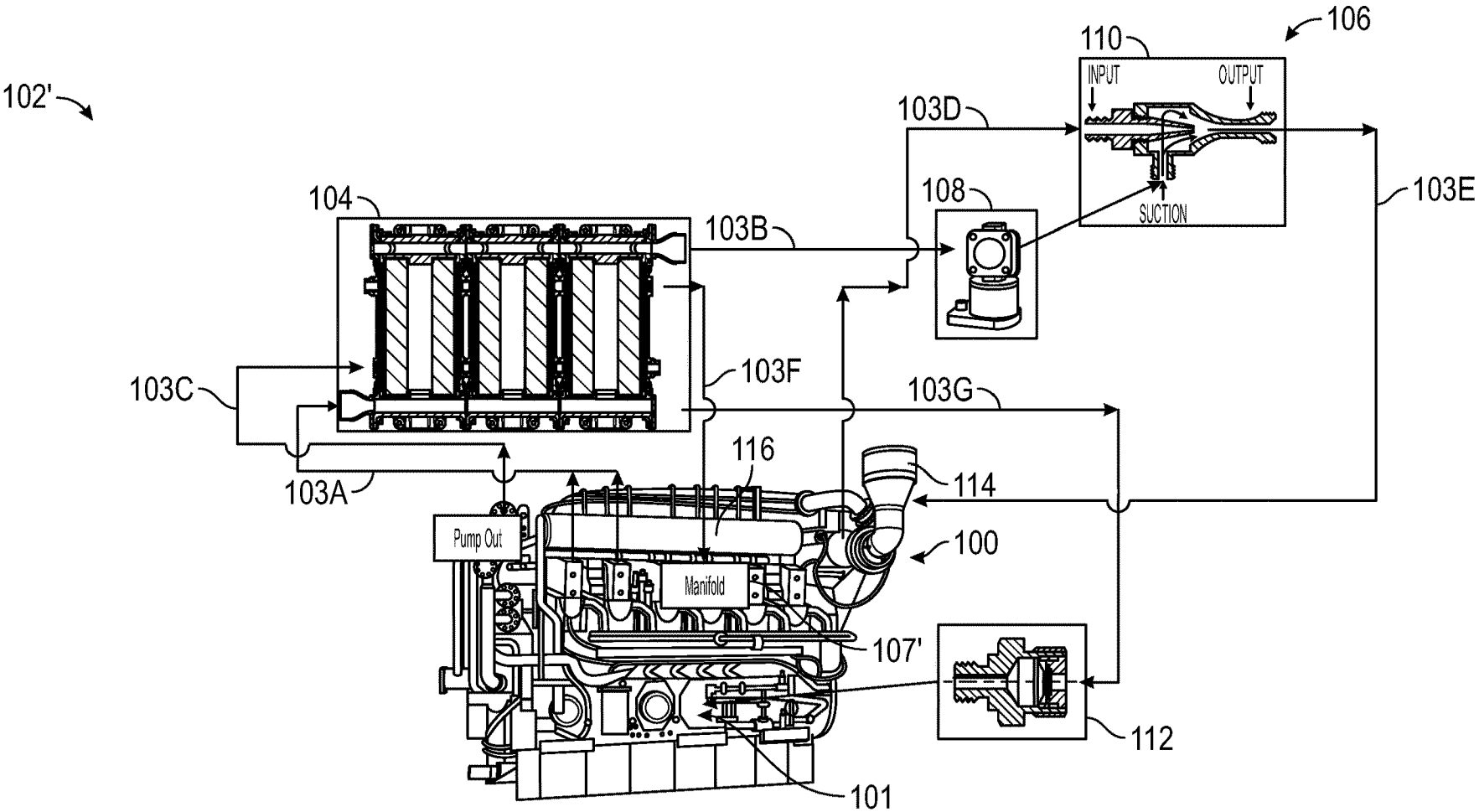
FIG. 1B is a schematic illustration depicting a second example of an engine system including the blow-by gas oil separation device with components maintained at a desired temperature range using on engine coolant in accordance with an example of the present application.
Figure 1C:
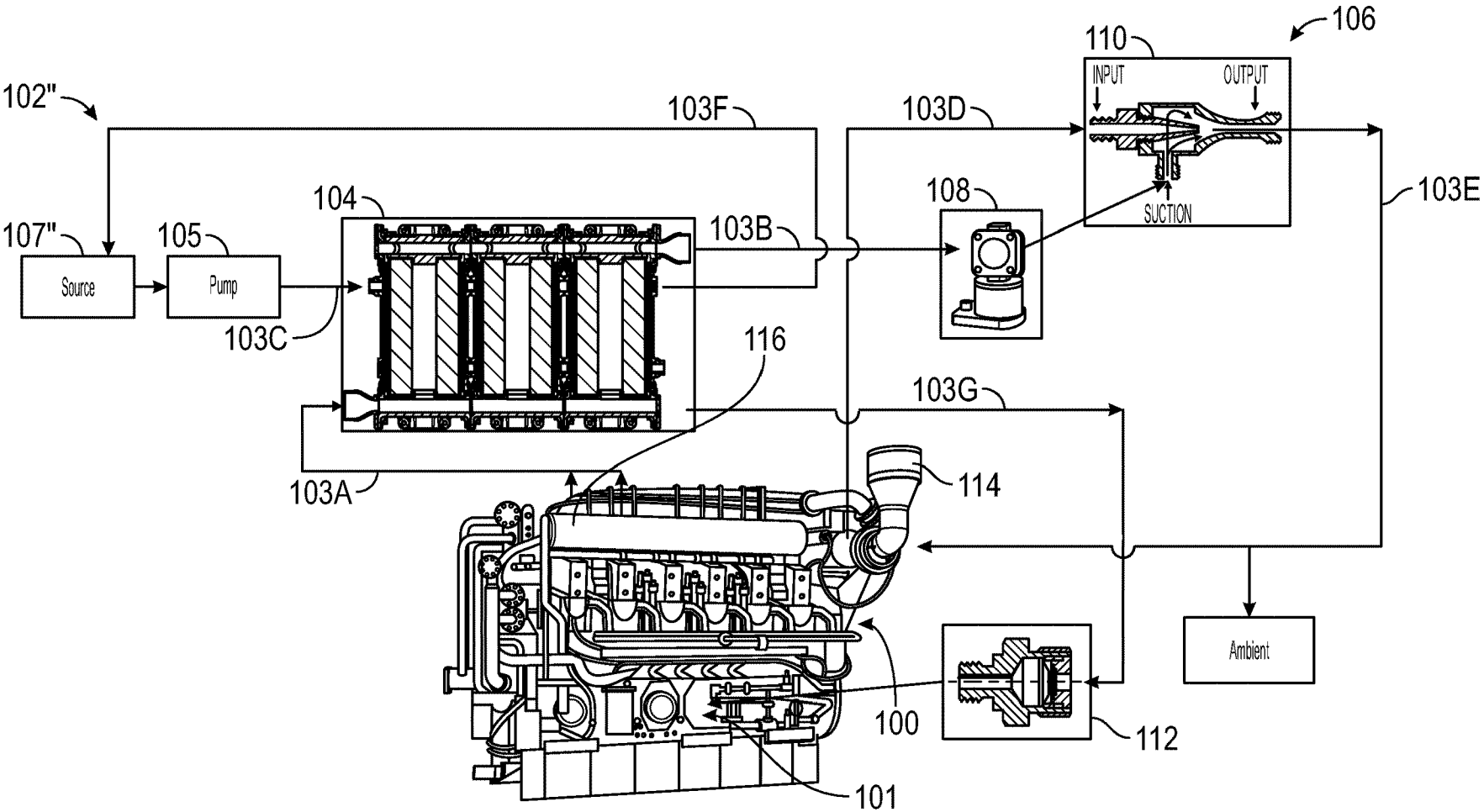
FIG. 1C is a schematic illustration depicting a third example of an engine system including the blow-by gas oil separation device with components maintained at a desired temperature range using off engine liquid in accordance with an example of the present application.

FIGS. 1A-1C depict an example schematic illustration of an engine 100 in accordance with this disclosure. The engine 100 can be used for power generation such as for the propulsion of vehicles or other machinery. The engine 100 can include various power generation platforms, including, for example, an internal combustion engine, whether gasoline, natural gas, dynamic gas blending, or diesel. It is understood that the present disclosure can apply to any number of piston-cylinder arrangements and a variety of engine configurations including, but not limited to, V-engines, inline engines, and horizontally opposed engines, as well as overhead cam and cam-in-block configurations.

In some applications, the internal combustion engines disclosed here are contemplated for use in gas compression. Thus, the internal combustion engines can be used in stationary applications in some examples. In other applications the internal combustion engines disclosed can be used with vehicles and machinery that include those related to various industries, including, as examples, oil exploration, construction, agriculture, forestry, transportation, material handling, waste management, etc.

According to the examples of FIGS. 1A-1C, the engine 100 can include systems 102 (FIG. 1A), 102' (FIG. 1B) and 102" (FIG. 1C) with at least one oil separation device 104 (array of a plurality of oil separation devices 104 shown). The systems 102, 102', and 102" can include auxiliary components 106 to the engine 100 such as a regulator 108, jet pump 110 and a check valve 112. The check valve 112 can be placed, for example, at the bottom of the oil drain sub-system to prevent unfiltered blow-by gas from bypassing a coalescing filter of the oil separation device 104 and passing directly to a compressor 114. Thus, the check valve 112 can regulate the flow of oil.

In the examples of FIGS. 1A-1C, the systems 102, 102', and 102" can be part of the original manufacture of the engine 100 or can be a retrofitted system that is added to the engine 100 during maintenance, upgrade or the like. As will be discussed in further detail subsequently, the systems 102, 102', and 102" can use the oil separation device(s) 104 to filter oil from the blow-by gas to reduce volatile content in the blow-by gas.

The systems 102, 102', and 102" can be part of a purge system, which can be in fluid communication with a crankcase 101 of the engine 100 such as via an inlet passageway. The systems 102, 102', and 102" can be configured to supply air to the crankcase and through the engine block or through other components (not shown) to a cylinder head of the engine 100. The air can act to ventilate the crankcase 101 and other components of the engine 100 such as the cylinder head, the rocker box, etc. This ventilation, in addition to operation of the oil separation device(s) 104 to separate oil from the blow-by gas, can dilute un-combusted fuel, explosive gases and/or volatiles below a lower explosive limit so as to prevent or reduce the likelihood of an explosion within the engine 100.

The systems 102, 102', and 102" can include connected passages (some specifically illustrated by arrows and numbered in FIG. 1) that are in fluid communication with various components of the systems 102, 102', and 102". Some components of the engine 100 such as the engine block, the crankcase 101, the cylinder head, the rocker box, the valve cover and/or the breather can be in fluid communication. The terms "passage", "passages", "passageway", "passageways", "line" or "lines" as used herein should be interpreted broadly. These terms can be features defined by the various components of the engine illustrated in the FIGURES or can be formed by additional components (e.g., a hose, tube, pipe, manifold, cavity etc.) as known in the art. These additional components can be external to the engine 100 in some examples. Passageways can also connect the regulator 108, the jet pump 110 and the check valve 112 with selected parts of the oil separation device(s) 104 as further described herein.

The systems 102, 102', and 102" can include passages and other components such as those shown in FIGS. 1A-1C. Dirty blow-by gas containing oil and volatiles of the systems 102, 102', and 102" can pass along a passage 103A from a breather or other device of the engine 100 and can pass to the oil separation device(s) 104 for filtering of oil to reduce volatile content of the blow-by gas. The blow-by gas, after filtering of the oil, can pass from the oil separation device(s) 104 along passage 103B to the regulator 108 (e.g., a vacuum control valve, mechanical valve or similar regulating device) located between the oil separation device(s) 104 and the jet pump 110. The blow-by gas can pass from the regulator 108 to the suction of the jet pump 110. The regulator 108 (e.g., the vacuum control valve) can be in fluid communication with the blow-by gas. The regulator 108 can be configured to regulate a flow of the blow-by gas to control a vacuum of the jet pump 110.

According to the example of FIG. 1A, the system 102 can utilize an on engine liquid such as lube oil of the engine 100. This liquid (here lube oil) can be passed along the passage 103C from a source such as an oil sump 107 of the engine 100 and through one or more jackets of the oil separation device(s) 104. This arrangement can keep the filter (and hence, the blow-by gas passing through the filter) of each of the oil separation device(s) 104 at a desired temperature range of between about 70 degrees Celsius and about 90 degrees Celsius, for example. However, other temperature ranges (e.g., between about 70 degrees Celsius and about 120 degrees Celsius) are contemplated. The lube oil can be heated and circulated through the jacket including prior to engine startup by existing on engine or off engine components as known in the art. The lube oil can have a desired temperature range of between about degrees Celsius and about 90 degrees Celsius or between about 70 degrees Celsius and about 120 degrees Celsius, for example. The lube oil can remain heated to the desired temperature range after engine startup and during operation of the engine according to some examples. An on engine oil pump or other flow generating device can be used to pass the oil to the jacket(s) of the oil separation device(s) 104. After passing through the jacket(s) of the oil separation device(s) 104 the lube oil can be returned to the oil sump 107 of the engine 100 along passage 103F. According to some examples, the passage 103F can be distinct from, can connect with or be part of a passage 103G that transports oil separated from the blow-by gas by the filter(s) of the oil separation device(s) 104 back to the oil sump 107.

In FIG. 1B, the system 102' can utilize an on engine liquid such as engine coolant (e.g., jacket water) of the engine 100. This liquid (here engine coolant) can be passed along the passage 103C from a source such as a coolant manifold 107' of the engine 100 and through one or more jackets of the oil separation device(s) 104. This arrangement can keep the filter (and hence, the blow-by gas passing through the filter) of each of the oil separation device(s) 104 at a desired temperature range of between about 70 degrees Celsius and about 90 degrees Celsius, for example. However, other temperature ranges (e.g., between about 70 degrees Celsius and about 120 degrees Celsius) are contemplated. The engine coolant can be heated and circulated through the jacket including prior to engine startup by existing on engine or off engine components as known in the art. The engine coolant can have a desired temperature range of between about 70 degrees Celsius and about 90 degrees Celsius or between about 70 degrees Celsius and about 120 degrees Celsius, for example. The engine coolant can remain heated to the desired temperature range after engine startup and during operation of the engine according to some examples. An on engine pump or other flow generating device can be used to pass the coolant to the jacket(s) of the oil separation device(s) 104. After passing through the jacket(s) of the oil separation device(s) 104 the engine coolant can be returned to the coolant manifold 107' of the engine 100 along passage 103F.

FIG. 1C shows an example of the system 102" that can utilize an off engine liquid such as oil, coolant (e.g., water, etc.). This liquid can be passed along the passage 103C from an off-engine source 107" such as a manifold and through one or more jackets of the oil separation device(s) 104. This arrangement can keep the filter (and hence, the blow-by gas passing through the filter) of each of the oil separation device(s) 104 at a desired temperature range of between about 70 degrees Celsius and about 90 degrees Celsius, for example. However, other temperature ranges (e.g., between about 70 degrees Celsius and about 120 degrees Celsius) are contemplated. The off-engine liquid can be heated and circulated through the jacket including by the system 102" prior to engine startup by existing off engine components as known in the art. The off-engine liquid can have a desired temperature range of between about 70 degrees Celsius and about 90 degrees Celsius or between about 70 degrees Celsius and about 120 degrees Celsius, for example. The off engine liquid can be decoupled from the oil separation device(s) 104 and another liquid (such as the on engine liquid of FIGS. 1A or 1B) can be used after engine startup and during operation of the engine according to some examples. A pump 105 or other flow generating device can be used to pass the off engine liquid to the one or more jackets of the oil separation device(s) 104. After passing through the one or more jackets of the oil separation device(s) 104 the liquid can be returned to the off-engine source 107" along passage 103F.

According to the examples of FIGS. 1A-1C, the systems 102, 102', and 102" can utilize boost air. The boost air can pass along a passage 103D and can bypass and be separate from the oil separation device(s) 104. The passage 103D can couple to one or more of the compressor 114 (or other component such as a turbocharger) and/or an aftercooler 116 of the engine 100 and can extend to the inlet of the jet pump 110. The boost air can be mixed in a desired ratio from the compressor 114 and/or the aftercooler 116.

According to yet further examples not specifically shown in this application, the boost air from the compressor 114 (or other component such as a turbocharger) and/or air from the aftercooler 116 can pass through the one or more jackets of the oil separation device(s) 104 to maintain the filter (and hence, the blow-by gas passing through the filter) of each of the oil separation device(s) 104 at the desired temperature range. The boost air can be mixed in a desired ratio and passed through one or more jackets of the oil separation device(s) 104. Such arrangement can keep the filter of each of the oil separation device(s) 104 at between about 70 degrees Celsius and 120 degrees Celsius, for example.

The liquids of FIGS. 1A-1C or the boost air can be used to achieve the desired temperature range above the dew point temperature of the blow-by gas and below a temperature at which one or more components of the oil separating apparatus become inoperable (fail due to melting or other modality).

The jet pump 110 can use the boost air as motive air for drawing the blow-by gas through the oil separation device(s) 104. The blow-by gas after leaving the oil separation device(s) 104 can be routed to a suction port of the jet pump 110 along the passage 103B. The boost air can be routed to an inlet port of the jet pump 110. The blow-by gas and the boost air can be combined in the jet pump 110. In particular, jet pump 110 can be configured to pass the blow-by gas and the boost air through a venturi of the jet pump 110. Some or all of the combined motive air and blow-by gas can pass along passage 103E to be returned to the engine 100, for example as an inlet to the compressor 114. Some or all of the combined motive air and blow-by gas can also be routed to ambient. The air can pass to the compressor 114, which can be configured to receive and compress the air. The compressed air can pass from the compressor 114 to the aftercooler 116. Thus, the aftercooler 116 can be in fluid communication with the compressor 114. The aftercooler 116 can be configured to receive and cool at least a portion of the compressed air.

To briefly summarize, the crankcase 101 can having a blow-by gas passing therethrough. The oil separation device(s) 104 can be in fluid communication with the blow-by gas and configured to separate oil from the blow-by gas. A mass flow rate of the boost air can be between 0.5% and 2.5% of a mass flow rate of the air received by the compressor 114. The liquids of FIGS. 1A-1C can be passed through the oil separation device(s) 104 in a heat exchange relationship with the blow-by gas to maintain the temperature of the blow-by gas within the oil separation device(s) 104 at the desired temperature range. The systems 102, 102', and 102" can include the jet pump 110, which can be in fluid communication with both the blow-by gas after leaving the oil separation device(s) 104 and the boost air after leaving the oil separation device(s) 104. The jet pump 110 can be configured to combine the blow-by gas and the boost air.

After leaving the jet pump, the combined blow-by gas and the boost air can be routed to at least one of the compressor 114 or ambient.

The systems 102, 102', and 102" can be configured to maintain a temperature for the filter somewhere between 70 degree Celsius to 120 degrees Celsius. The liquid can be passed to the jacket of each of the oil separation device(s) 104 the keep the filter of each of the oil separation device(s) 104 (and hence, the blow-by gas passing through) at between about 70 degrees Celsius and 90 degrees Celsius or about 70 degrees Celsius and 120 degrees Celsius, for example. Separate from this process, the systems 102, 102', and 102" can utilize boost air. The boost air can be fed to the jet pump 110 as motive air to pass the blow-by gas through the oil separation device(s) 104. Passage of the motive air through the jet pump 110 can create a vacuum that can be modulated by the regulator 108 (e.g., vacuum control valve or a mechanical valve). The regulator 108 can modulate the vacuum at the outlet of the systems 102, 102', and 102" and can regulate crankcase pressure (via flow of blow-by gas to the suction of the jet pump 110). Additionally, the filter(s) of the oil separation device(s) 104 is heated, cooled or maintained at a desired temperature using the boost air.

Figure 2A:
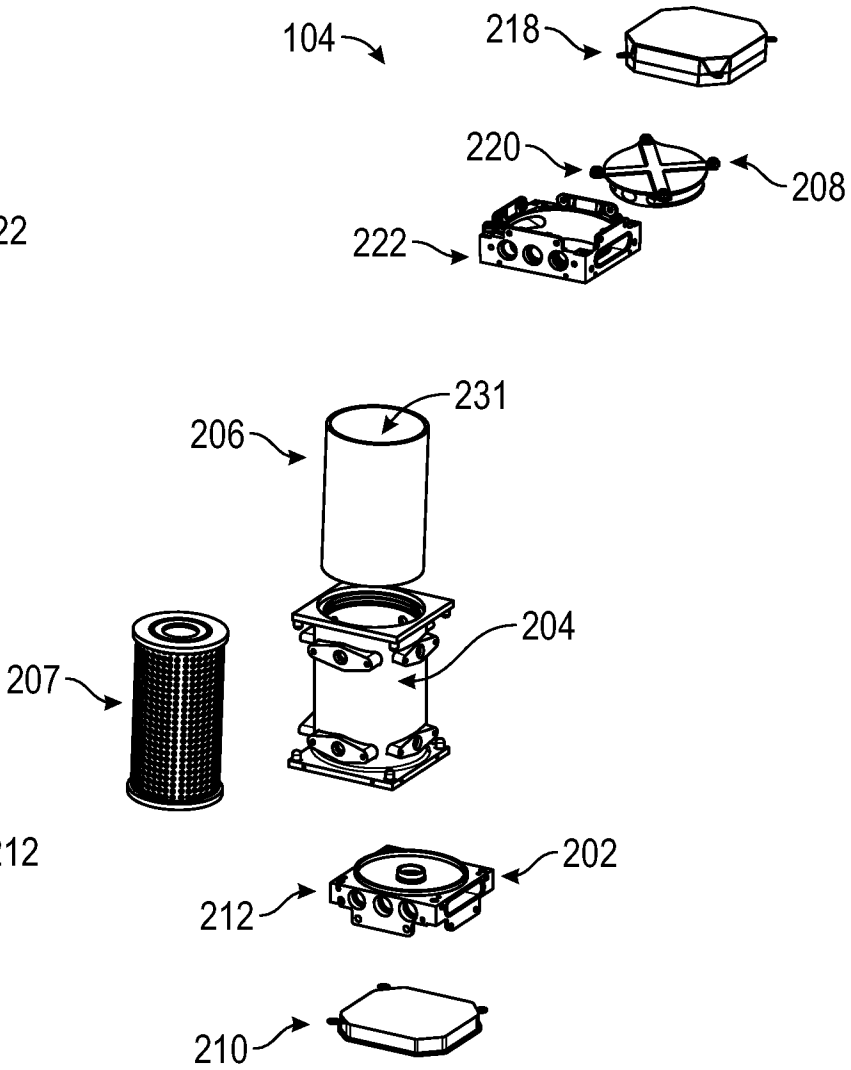
FIG. 2A is an exploded view of components of the oil separation device of FIG. 2.
Figure 2:
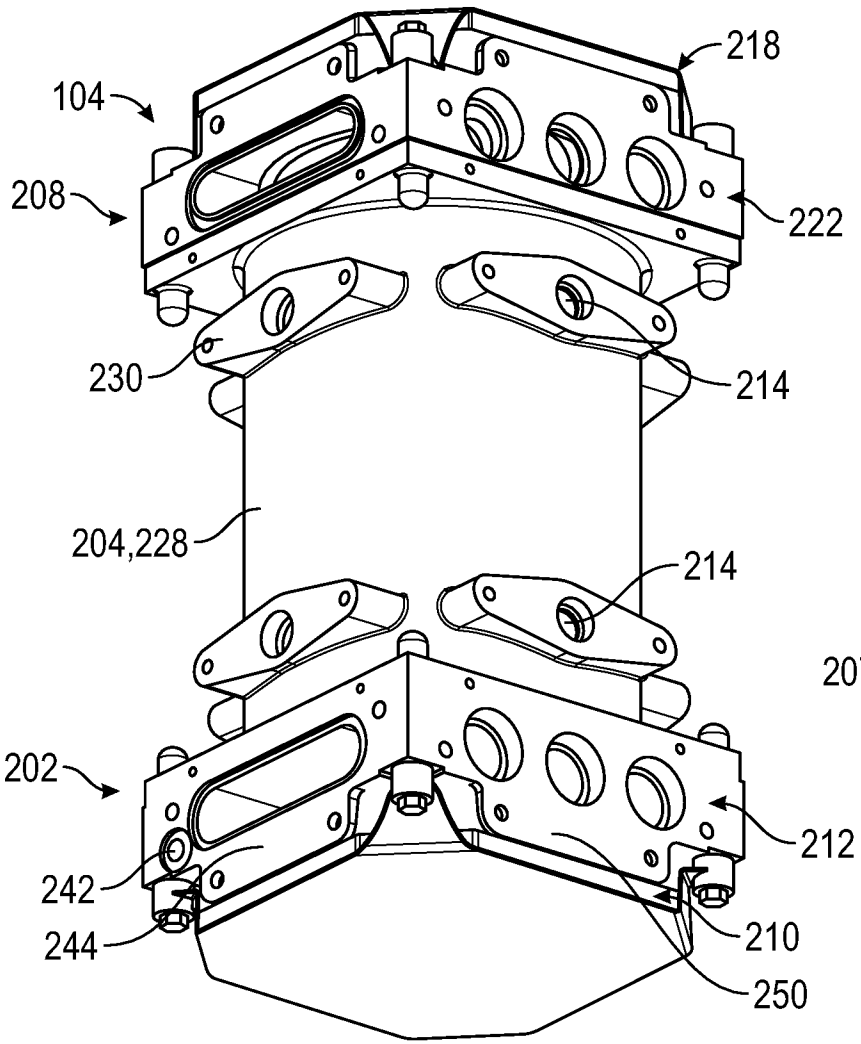
FIG. 2 is a perspective view of the oil separation device according to one example of the present application.

FIG. 2 shows an example of the oil separation device 104 that can be used with the systems 102, 102', and 102" described previously. FIG. 2A shows an exploded view of components of the oil separation device 104. As shown in FIG. 2A, the oil separation device 104 can include a first cover 202, an outer housing 204, an inner housing 206, a coalescing filter 207 and a second cover 208. Referring now to FIGS. 2 and 2A, the first cover 202 can include an insulative material 210 and a main body 212. Referring now to FIG. 2, the outer housing 204 can include one or more ports 214. As shown in FIGS. 2 and 2A, the second cover 208 can include an insulative material 218, a service plug 220 (FIG. 2A) and a main body 222.

As shown in FIG. 2, the first cover 202 can be connected to a first end portion of the outer housing 204 by fastener, weld, solder, threading or other mechanical connection as known in the art. Similarly, the second cover 208 can be connected to a second end portion of the outer housing 204 in a similar manner to the first cover 202. The second end portion can generally oppose the first end portion.

The first cover 202 and/or the second cover 208 can be part of the outer housing 204 according to further examples rather than being a separate component. For example, the outer housing 204, the first cover 202 and/or the second cover 208 could comprise an integral single piece assembly according to some examples.

The first cover 202 and the second cover 208 can have a square, rectangular, circular, or other shape in cross-section as desired and can be constructed of any suitable material(s). The main body 212 can form exterior walls, faces, one or more manifolds and other features of the first cover 202. In brief, the main body 212 can be configured to form a plurality of ports for communication of blow-by gas into or out of the oil separation device 104. These ports and other features will be discussed and illustrated in further detail subsequently. The insulative material 210 can abut or be in close proximity to and extend over one or more sides of the main body 212 such as at an end thereof. The insulative material 210 can be held in place with mechanical fasteners, a plate (shown in FIGS. 2 and 2A) and/or other feature or components. According to one example, the insulative material 210 can be a fiberglass insulation encapsulated within a stainless steel foil, or a steel outer shell with an integral foam insulative underlayer.

Figure 2C:
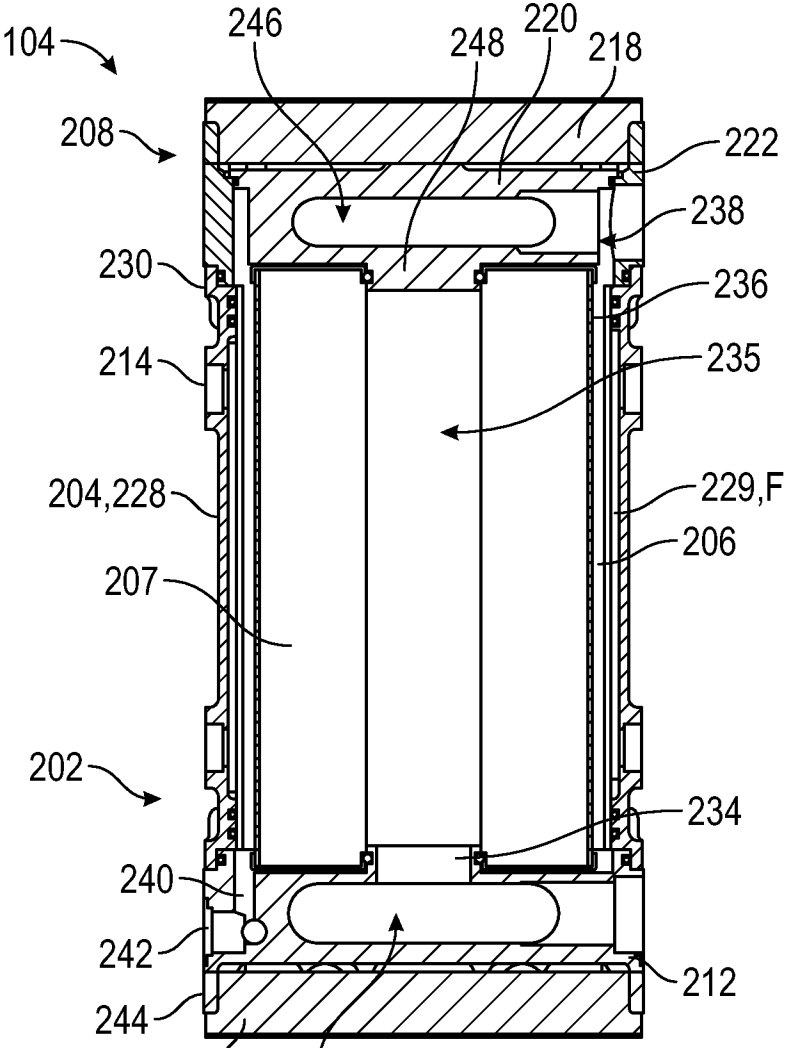
FIG. 2C is a second cross-sectional view of the oil separation device of FIG. 2.
Figure 2B:
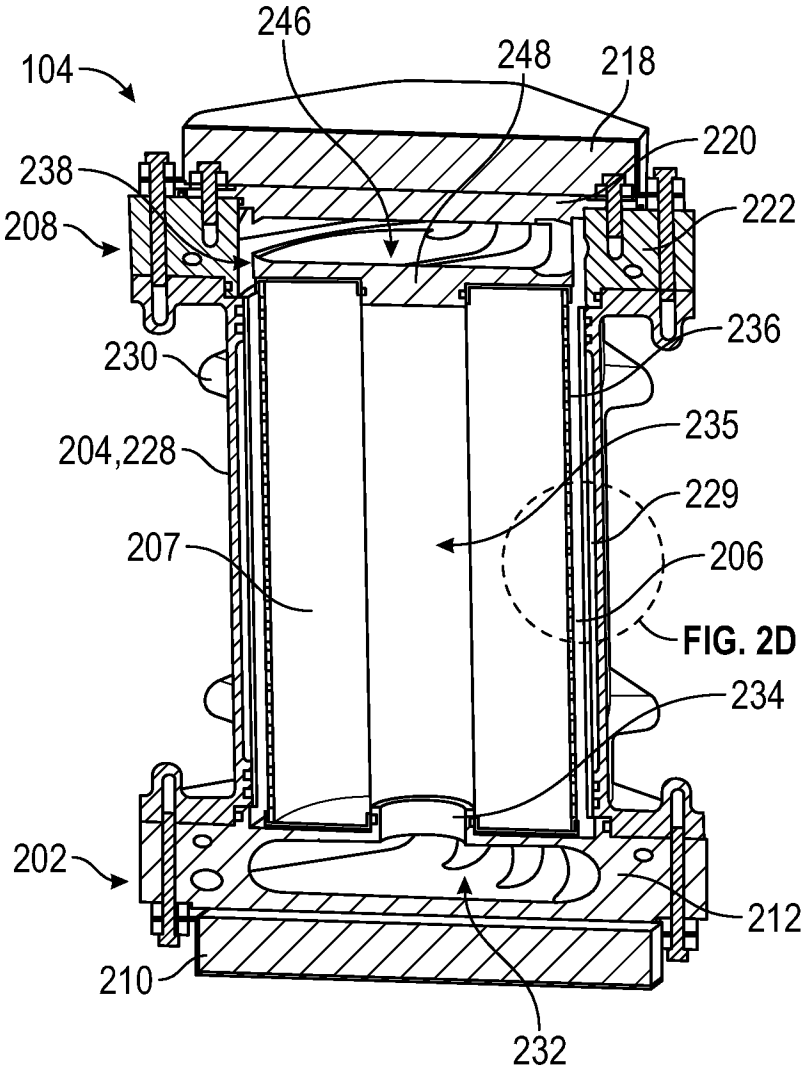
FIG. 2B is a first cross-sectional view of the oil separation device of FIG. 2.
Figure 2D:
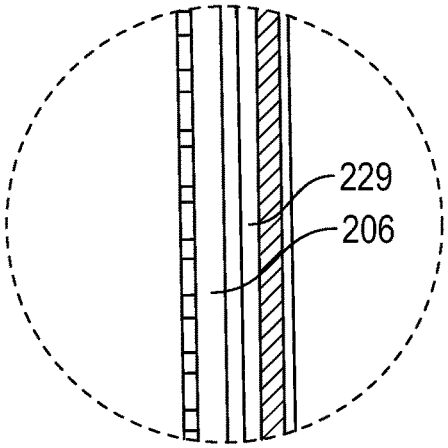
FIG. 2D is an enlarged view of the cross-sectional view of FIG. 2B.

The outer housing 204 can have a hollow tubular shape, for example. This shape can form an inner cavity configured to receive the inner housing 206. Thus, the inner housing 206 can be positioned within the outer housing 204. The inner housing 206 and the outer housing 204 can be constructed of suitable material(s). Although the outer housing 204 and the inner housing 206 are illustrated as separate components in the FIGURES, it is contemplated in some examples that these could be integrally formed as a single piece such as by casting or another forming technique. The outer housing 204 can form a wall 228 with the ports 214 passing through the wall 228. These ports 214 can provide inlet(s) or outlet(s) as desired and can be in fluid communication with a jacket 229 (FIGS. 2B, 2C and 2D). The jacket 229 can comprise a sealed (from the inner cavity, the blow-by gas, oil and coalescing filter 207) cavity formed between an interior side of the wall 228 of the outer housing 204 and an outer surface of the inner housing 206 (see FIGS. 2B, 2C and 2D). The ports 214 can be located at specifically configured flanges 230 or other features of the outer housing 206. Thus, the jacket 229 can be formed between the inner housing 206 and the outer housing 204. The flanges 230 can form different faces of the outer housing 206. These faces of the outer housing 206 can correspond with faces of the first cover 202 and/or the second cover 208 as further discussed subsequently.

Returning to the jacket 229, the jacket 229 can be cylindrically shaped having only the ports 214 for fluid communication. The jacket 229 can be configured to receive one or more of an electrical heater coil, an insulative material, a sealed air gap, or a positive mass flow of pressurized engine boost air, engine coolant, or engine lube oil. More particularly, electrically resistive heating coils can be placed in the jacket 229 so as to provide heating to the inner housing 206 and the coalescing filter 207. This can be useful if the oil separation device 104 is being operated in a cold environment. Alternatively or additionally, insulative material such as foam or the like can be placed in the jacket 229 to provide for insulation of the coalescing filter 207 (and blow-by gas) from a harsh environment. The jacket 229 can also receive in addition or alternative to the heating coil and/or insulation, a liquid (as discussed previously in reference to FIGS. 1A-1C) that can be used for heating or cooling the coalescing filter 207 (and the blow-by gas). Such liquid or fluid can be anyone or combination of a sealed air gap, or a positive mass flow of pressurized engine boost air, engine coolant (FIG. 1B), or engine lube oil (FIG. 1A), for example. However, the liquid or fluid is not limited to these examples.

The main body 222 can form exterior walls, faces, one or more manifolds and other features of the second cover 208. The main body 222 can be configured to form a plurality of ports for communication of blow-by gas into or out of the oil separation device 104. These ports will be discussed and illustrated in further detail subsequently. The service plug 220 can be configured to couple with the main body 222 and can be selectively removable therefrom. The service plug 220 can allow access to an inner cavity (formed by the inner housing 206) and the coalescing filter 207. The coalescing filter 207 can be removed and changed for a new filter with selective removal of the service plug 220 from the main body 222. The insulative material 218 can abut or be in close proximity to and extend over one or more sides of the main body 222 and the service plug 220. The insulative material 218 can be held in place with mechanical fasteners, a plate (shown in FIGS. 2 and 2A) and/or other features or components in a manner similar to that if the insulative material 210 of the first cover 202. The insulative material 218 can be identical to or can differ from the insulative material 210, in regard to shape, size or composition.

FIGS. 2B and 2C show different cross-sections of the oil separation device 104. FIGS. 2B and 2C show the first cover 202, the outer housing 204, the inner housing 206, the coalescing filter 207, the second cover 208 and other aspects including internal features and aspects of the oil separation device 104.

The first cover 202 can couple to the outer housing 204 so as to abut or be in close proximity to the coalescing filter 207. The inner housing 206 can be positioned within the outer housing 204 and can be sealed thereto. The inner housing 206 can comprise a sleeve having a hollow construction forming an inner cavity 231 (FIG. 2A) for receiving the coalescing filter 207.

As shown in FIGS. 2B and 2C, the first cover 202, specifically the main body 212, can form a first manifold 232 internally. The first manifold 232 can be in fluid communication with a plurality of ports (discussed further in reference to FIGS. 3A-3C). The first manifold 232 can include a central port 234 that allows for fluid communication between the first manifold 232 and a central passage 235 of the coalescing filter 207.

The blow-by gas passing through the central passage 235 can carry oil from the engine and/or from the crankcase. The coalescing filter 207 is configured to separate a portion of the oil contained in the blow-by gas. The coalescing filter 207 can have a generally cylindrical shape about the central passage 235. The coalescing filter 207 can have a construction known in the art. As an example, the coalescing filter 207 can be constructed using a single or multi-layer synthetic coalescing filter media wound around a core, or pleated. In addition to the coalescing filter media, the coalescing filter will also include end caps and associated seals and may include an inner and outer perforated tube structure to provide the axial, torsional, and bending stiffness required for the application.

The blow-by gas containing oil can pass radially outward through the coalescing filter 207 to an outer circumference thereof. During such passage, the configuration of the coalescing filter 207 can cause coalescing of the oil from the blow-by gas. Such coalescing can result in separation of the oil from the blow-by gas. The oil once coalesced can travel to the outer circumference of the coalescing filter 207 and can pass to an outer cavity 236 surrounding the outer circumference of the coalescing filter 207. The inner housing 206 can be spaced from the outer circumference of the coalescing filter 207. This gap can be the outer cavity 236. The blow-by gas that is separated from the oil by action of the coalescing filter 207 can pass from the coalescing filter 207 into the outer cavity 236 and can pass from the outer cavity 236 through one or more passages 238 (FIG. 2C) in fluid communication with the outer cavity 236 into the second cover 208. These one or more passages 238 can be relatively extensive, communicating with the outer cavity 236 around substantially all (over 90%), most (60%-89%), a majority (50%-59%), some (25%-49% or part (5%-24%) of the outer circumference of the coalescing filter 207. The one or more passages 238 can be at least partially formed by a gap between the main body 222 and the service plug 220, for example. Other examples contemplate the one or more passages 238 being formed by dedicated apertures or other features in only one of the main body 222 and the service plug 220.

As shown in FIG. 2C, the outer cavity 236 can be in fluid communication with one or more passages 240 at an opposing end of the outer cavity 236 from the one or more passages 238. The one or more passages 240 can drain oil from the outer cavity 236 into the first cover 202. The one or more passages 240 can be at least partially formed by the main body 212 of the first cover 202. The one or more passages 240 can be separated from the first manifold 232 and can have an outlet port 242. This outlet port 242 can be located on one or more of the faces of the main body 212 such as a first face 244. Thus, the main body 212 can form the outlet port 242 and at least a portion of the one or more passages 240. The one or more passages 240 can be configured to receive the oil captured (separated by action of) by the coalescing filter 207 and can pass the oil as a drainage out of the oil separation device 104 at the outlet port 242.

The blow-by gas free from at least a portion of the oil therein by action of the coalescing filter 207 can pass through the one or more passages 238 into a second manifold 246 of the second cover 208. This second manifold 246 can be at least partially formed by the service plug 220 in addition to parts of the main body 222. The second manifold 246 can be in fluid communication with a plurality of ports (discussed further in reference to FIGS. 5 and 6).

As shown in FIGS. 2B and 2C, the service plug 220 can be arranged atop and abutting or in close proximity to the coalescing filter 207. The service plug 220 can include a projection 248 or other sealing feature configured to seal the central passage 235 of the coalescing filter 207.

Figure 3A:
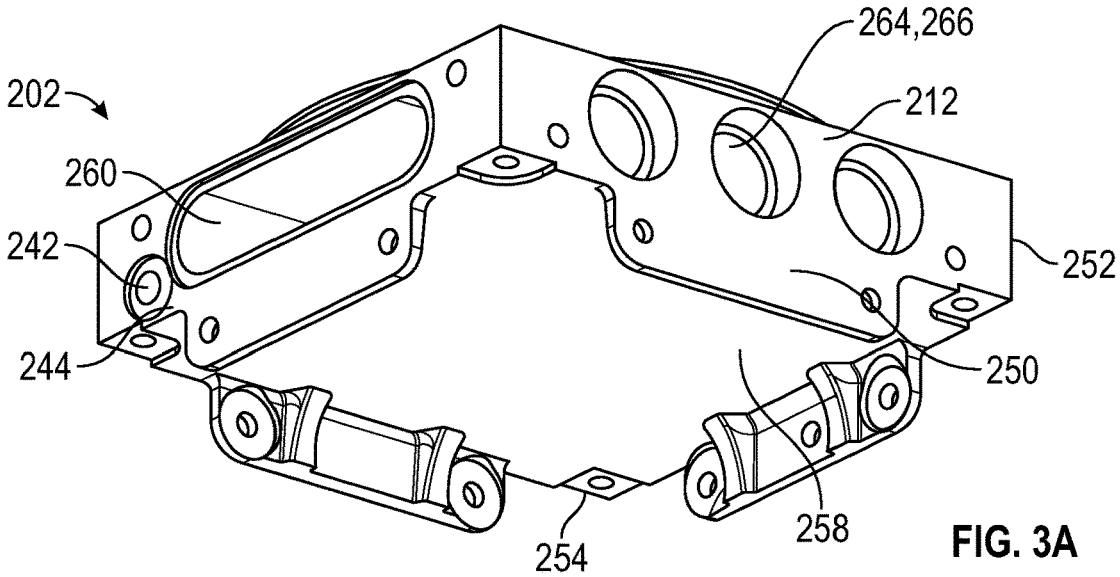
FIGS. 3A and 3B show various perspective views of a first cover of the oil separation device of FIG. 2 according to one example of the present application.
Figure 3B:
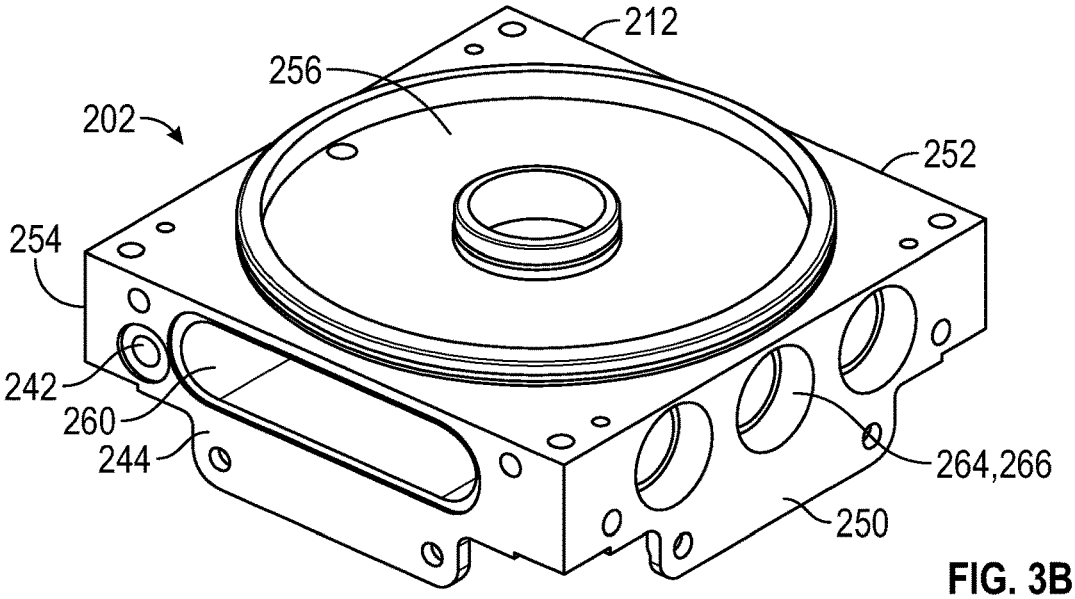
Figure 3C:
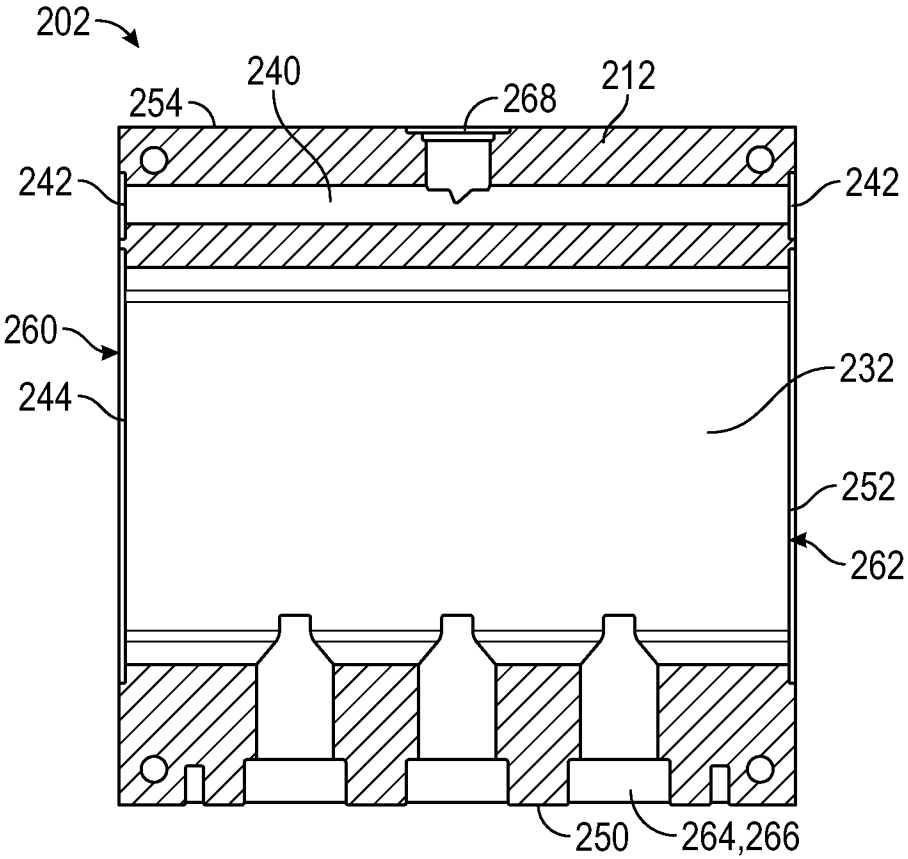
FIG. 3C is a cross-sectional view of the first cover of FIG. 3B.

FIGS. 3A-3C show aspects of the first cover 202, specifically the main body 212. FIG. 3C is a cross-section of the main body 212 showing the first manifold 232 and the one or more passages 240.

FIGS. 3A-3C show the first face 244 with the outlet port 242 for oil drainage. The main body 212 has a square cross-sectional construction according to the example shown. However, other cross-sectional shapes (circular, triangle, rectangle, pentagon, quadrilateral, hexagon, octagon, etc.) are also contemplated. A hybrid or non-symmetric shape can also be utilized.

Referring now selectively between FIG. 3B and FIG. 3C, the main body 212 can include a second face 250, a third face 252, a fourth face 254, a first end wall 256 (FIG. 3B), a second end wall 258 (FIG. 3B), a first port 260, a second port 262, a first plurality of flow passages 264 and a first plurality of ports 266.

The first face 244, the second face 250, the third face 252, the fourth face 254, the first end wall 256, the second end wall 258 (FIG. 3C) can have a unitary construction being formed by casting or other integral construction. The faces 244, 250, 252 and 254 can be generally substantially flat. However, the faces 244, 250, 252 and 254 can have other features such as curvatures, mating features and other connection mechanisms such as recesses, threaded apertures, etc. The first face 244 is connected to the second face 250, the fourth face 254, the first end wall 256 and the second end wall 258. Similarly, the second face 250 can be connected to the first face 244, the third face 252, the first end wall 256 and the second end wall 258. The third face 252 can generally oppose the first face 244 spaced by the first manifold 232, the first end wall 256 and the second end wall 258. The third face 252 can be connected to the second face 250, the fourth face 254, the first end wall 256 and the second end wall 258. The first end wall 256 can be spaced from the second end wall 258 by the first manifold 232 (FIG. 3C) in addition to the first face 244, the second face 250, the third face 252 and the fourth face 254.

FIGS. 3A-3C show the first face 244 can be arranged substantially perpendicular to the second face 250. The first face 244 can have the first port 260 in fluid communication with the first manifold 232 (FIG. 3C). The second face 250 can form the first plurality of flow passages 264 and the first plurality of ports 266.

The third face 252 can oppose the first face 244 spaced by the second face 250 and the fourth face 254. The third face 252 can be symmetrically shaped with respect to the first face 244. Thus, the second port 262 can be similarly shaped and sized with respect to the first port 260, for example. The second port 262 can be in fluid communication with the first manifold 232 in a similar manner to the first port 260 but opening in an opposing direction.

The second face 250 can differ in construction from the fourth face 254, the first face 244 and the third face 252. In particular, the second face 250 can include the first plurality of flow passages 264 and the first plurality of ports 266 while the fourth face 254 does not include any flow passages or ports communicating with an exterior for passage of blow-by gas. The fourth face 254 can include a passage and/or port 268 that can be part of or in fluid communication with the one or more passages 240 according to some examples. However, it is contemplated in some examples that the second face 250 and the fourth face 254 could share a same or similar construction including similar flow passages. The second face 250 and/or the fourth face 254 can have a same geometry as the first face 244 and the third face 252 according to further examples.

According to one example the first port 260, second port 262 and/or the first plurality of ports 266 can be configured to receive the blow-by gas into the oil separation device 104. However, it is contemplated that the flow direction of the blow-by gas through the oil separation device 104 can be reversed in further examples such that the first port 260, the second port 262 and/or the first plurality of ports 266 could be an outlet for the blow-by gas. The first port 260, the second port 262 and/or any one or combination of the first plurality of ports 266 can be selectively blocked from receiving blow-by gas with a cover, plug, plate or other feature to close the respective port according to some examples.

FIG. 3A shows the second end wall 258 on an outer side can be configured with flanges, recess, cavity, apertures etc. to receive and retain the insulative material 210 (FIGS. 2-2C). FIG. 3B shows the first end wall 256 on a side facing the outer housing 204, the inner housing 206, the coalescing filter 207 (FIGS. 2-2C) can have features such as lips, port, one or more apertures to facilitate passage of blow-by gas, or other features for sealing and retention of the first cover 202 to the outer housing 204, the inner housing 206, the coalescing filter 207.

Figure 4A:
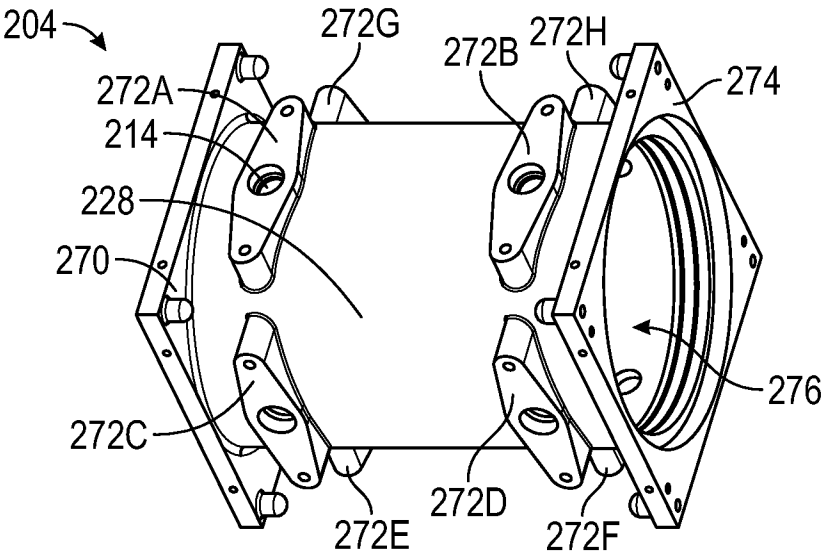
FIG. 4A is a perspective view of an outer housing of the oil separation device of FIG. 2 according to one example of the present application.

FIG. 4A illustrates the outer housing 204 according to one example. The outer housing 204 includes a first mounting flange 270, the wall 228, flanges 230 (referred to as one or more jacket flanges 272A, 272B, 272C, 272D, 272E, 272F, 272G and 272H below), ports 214 and a second mounting flange 274. These features can have a unitary construction being formed by casting or other integral construction.

The first mounting flange 270 can be configured for mounting to the first cover 202. Thus, the first mounting flange 270 can be designed to seat down and abut against the second end wall 258 (FIG. 3B), for example. The first mounting flange 270 can include sides that are shaped and sized to correspond with the shape and size of the first face 244, the second face 250, the third face 252, and/or the fourth face 254 (FIG. 3C).

The wall 228 can be connected to the first mounting flange 270 and the second mounting flange 274. The wall 228 can be generally cylindrical in shape, however, other exterior (or interior) shapes are contemplated. The wall 228 can form a relatively thin sleeve type structure and can define a hollow interior 276 (a portion of which is the outer cavity 236 discussed previously). The hollow interior 276 can be configured to receive the inner housing 206 and the coalescing filter 207 (FIGS. 2-2C) as previously discussed and illustrated.

The one or more jacket flanges 272A, 272B, 272C, 272D, 272E, 272F, 272G and 272H can project from the wall 228 and can comprise coupling features for sealing and/or facilitating communication to the jacket as further discussed. The jacket flanges 272A, 272B, 272C, 272D, 272E, 272F, 272G and 272H can project a distance that is similar to the sides of the first mounting flange 270, the second mounting flange 274 and/or the faces of the first and second covers 202, 210. This allows for direct interfacing of the jacket flanges 272A, 272B, 272C, 272D, 272E, 272F, 272G and 272H with other jacket flanges or other components as further discussed subsequently. The orientation of the jacket flanges 272A, 272B, 272C, 272D, 272E, 272F, 272G and 272H can correspond to the first face 244, the second face 250, the third face 252, the fourth face 254 (FIG. 3C). More particularly, the jacket flanges 272A and 272B can have an orientation and construction such that an outer surface thereof is generally parallel with and/or on a same plane with the first face 244 (see FIG. 2, for example). Similarly, the jacket flanges 272C and 272D can have an orientation and construction such that an outer surface thereof is generally parallel with and/or on a same plane with the second face 250 (see FIG. 2C, for example). Likewise, the jacket flanges 272E and 272F can have an orientation and construction such that an outer surface thereof is generally parallel with and/or on a same plane with the third face 252. The jacket flanges 272G and 272H can have an orientation and construction such that an outer surface thereof is generally parallel with and/or on a same plane with the fourth face 254 (see FIG. 2C, for example).

The ports 214 can provide for communication into the jacket 229 through the wall 228 and the jacket flanges 272A, 272B, 272C, 272D, 272E, 272F, 272G and 272H. The ports 214 can be located at one or more of the jacket flanges 272A, 272B, 272C, 272D, 272E, 272F, 272G and 272H.

The second mounting flange 274 can be configured for mounting to the second cover 208. Thus, the second mounting flange 274 can be designed to seat down and abut against the second cover 208, for example. The second mounting flange 274 can include sides that are shaped and sized to correspond with the shape and size of faces of the second cover 208.

Figure 4B:
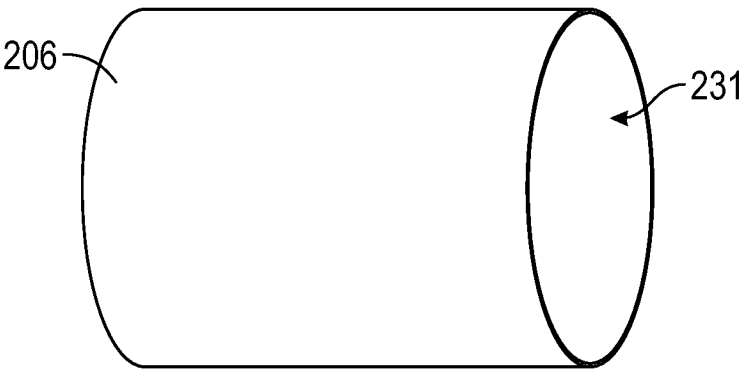
FIG. 4B is a perspective view of an inner housing of the oil separation device of FIG. 2 according to one example of the present application.

FIG. 4B shows the inner housing 206. This can be configured to be positioned within the outer housing 204 and can be sealed thereto thereby forming the jacket as previously discussed. The inner housing 206 can comprise a sleeve having a hollow construction forming the inner cavity 231 for receiving the coalescing filter 207 (FIGS. 2A-2C).

Figure 5:
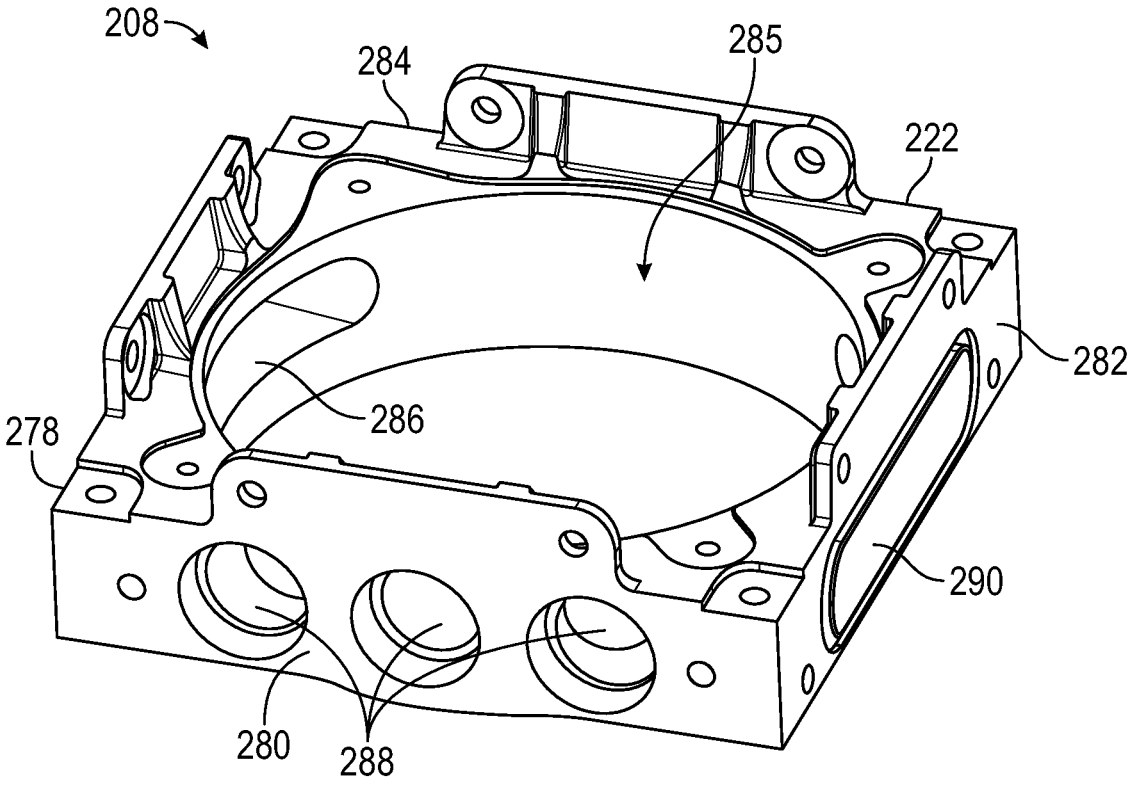
FIG. 5 is a perspective view of a first portion of a second cover of the oil separation device of FIG. 2 according to one example of the present application.

FIG. 5 shows the main body 222 of the second cover 208 according to one example. The main body 222 can have an open frame design with a first face 278, a second face 280, a third face 282, a fourth face 284 and a central opening 285. The first face 278 can have a first port 286. The second face 280 can have a second plurality of ports 288. The third face 282 can have a second port 290.

The main body 222 can have an exterior shape that substantially matches the main body 212 (FIGS. 3A-3C), for example. Thus, the main body 222 can have a square cross-sectional construction of a same size as that of the main body 212, according to the example shown. However, other cross-sectional shapes that differ from the main body 212 and other shapes in general (circular, triangle, rectangle, pentagon, quadrilateral, hexagon, octagon, etc.) are also contemplated. A hybrid or non-symmetric shape can also be utilized.

Figure 6:
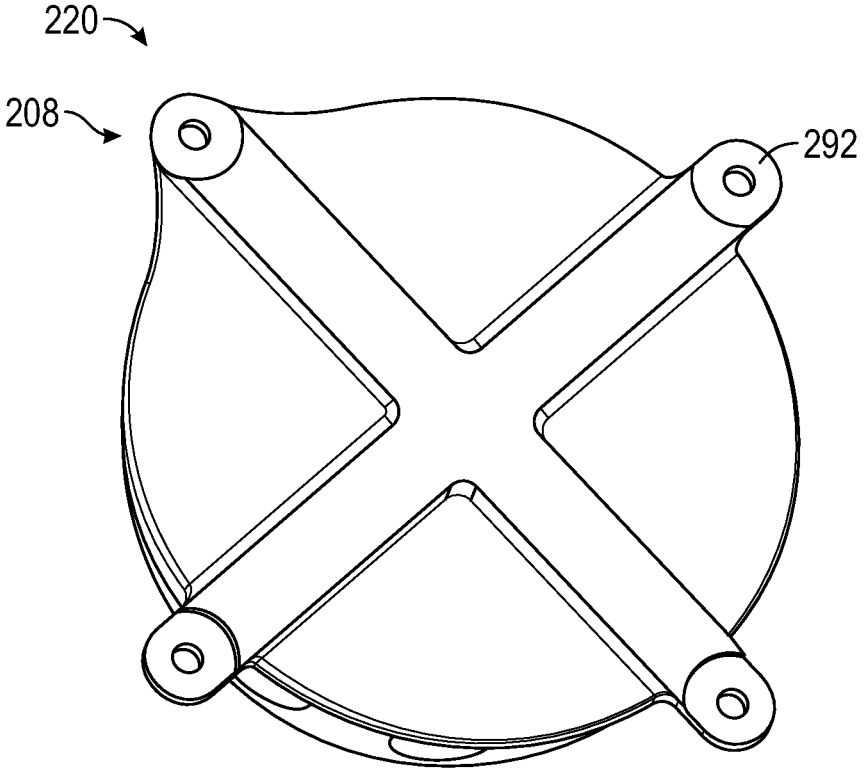
FIG. 6 is a perspective view of a second portion of the second cover of the oil separation device of FIG. 2 according to one example of the present application.

The main body 222 can have an open shell type configuration with the central opening 285 configured to receive the service plug 220 (FIG. 6). Thus, the main body 222 can differ in construction from the main body 212 in that it does not have the first end wall 256, the second end wall 258 (FIG. 3B). The first face 278, the second face 280, the third face 282 and the fourth face 284 can have a unitary construction being formed by casting or other integral construction. The faces 278, 280, 282 and 284 can be generally substantially flat. However, the faces 278, 280, 282 and 284 can have other features such as curvatures, mating features and other connection mechanisms such as recesses, threaded apertures, etc. The first face 278 is connected to the second face 280, the fourth face 284. Similarly, the second face 280 can be connected to the first face 278 and the third face 282. The third face 282 can generally oppose the first face 278 spaced by the central opening 285 and service plug 220 (not shown). The third face 282 can be connected to the second face 280 and the fourth face 284.

FIG. 5 shows the first face 278 can be arranged substantially perpendicular to the second face 280. The first face 278 can have the first port 286 in fluid communication with the central opening 285 and the service plug 220 (when inserted therein). The second face 280 can form the second plurality of ports 288.

The third face 282 can oppose the first face 278 spaced by the second face 280 and the fourth face 284. The third face 282 can be symmetrically shaped with respect to the first face 278. Thus, the second port 290 can be similarly shaped and sized with respect to the first port 286, for example. The second port 290 can be in fluid communication with the central opening 285 (and the service plug 220 when inserted therein) in a similar manner to the first port 286 but opening in an opposing direction.

The second face 280 can differ in construction from the fourth face 284. In particular, the second face 280 can include the first plurality of ports 288 while the fourth face 284 does not include any flow passages or ports communicating with an exterior for passage of blow-by gas. However, it is contemplated in some examples that the second face 280 and the fourth face 284 could share a same or similar construction including similar flow passages. Additionally, one or more of the second face 280 and/or fourth face 284 could have a same geometry as the first face 278 and/or the third face 282.

The first port 286, second port 290 and/or the second plurality of ports 288 can be configured as outlets to pass the blow-by gas from the oil separation device 104 back toward the engine and/or other auxiliary components. However, it is contemplated that the flow direction of the blow-by gas through the oil separation device 104 can be reversed in further examples such that the first port 286, the second port 290 and/or the second plurality of ports 288 could be an inlets for the blow-by gas. The first port 286, the second port 290 and/or any one or combination of the second plurality of ports 288 can be selectively blocked from receiving blow-by gas with a cover, plug, plate or other feature to close the respective port according to some examples.

FIG. 5 shows a top portion of the main body 222 on an outer side can be configured with flanges, recess, apertures etc. to receive and retain the insulative material 218 (FIGS. 2-2C) and the service plug 220 (FIG. 6).

FIG. 6 shows further details of the service plug 220. Referring now to FIG. 6, the service plug 220, which can include a second manifold, passages and other features.

The service plug 220 can be selectively attachable to the main body 222 (FIG. 5) using the coupling features 292 and fasteners (not shown). The service plug 220 can be selectively removable from the main body 222.

The service plug 220 can have a generally cylindrical shape with an open frame construction as a result of the second manifold and the passages formed therein.

Figure 7:
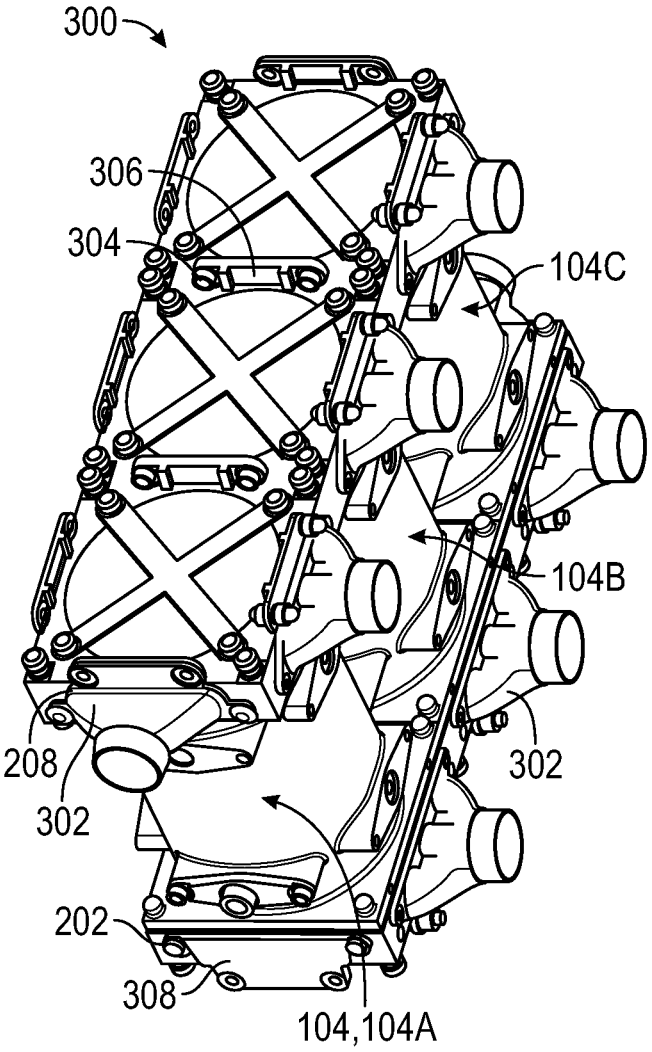
FIG. 7 shows an assembly of a plurality of oil separation devices arranged in a single row array with a first configuration according to one example of the present application.

FIG. 7 shows an example of a single row array 300 that can be created using a plurality of the oil separation devices 104 selectively coupled together.

More particularly, the single row array 300 can each include three of the oil separation devices 104. The oil separation devices 104 can be in fluid communication with one another and/or in fluid communication with one or more blow-by gas coupling apparatuses 302.

The single row array 300 can be created by selectively connecting a first oil separation device 104A at the third faces thereof with a second oil separation device 104B at the first faces thereof. The second oil separation device 104B can be connected to a third oil separation device 104C at the third face thereof. The first faces of the third oil separation device 104C can interface with the third faces of the second oil separation device 104B. The first oil separation device 104A can utilize one or more fasteners 304 that attach the respective abutting flanges 306 of the first oil separation device 104A and the second oil separation device 104B. Similarly, the second oil separation device 104B can utilize one or more fasteners 304 that attach the respective abutting flanges 306 of the second oil separation device 104B and the third oil separation device 104C. A similar arrangement of fasteners and flanges can be utilized with the first covers of the first, second and third oil separation devices 104A, 104B and 104C. Thus, the first oil separation device 104A can abut or can be spaced in close proximity to and can be coupled with the second oil separation device 104B along at least one face of the first cover 202 and at least one face of the second cover 208. The second oil separation device 104B can abut or be spaced a small distance from and can be coupled with the third oil separation device 104C along at least one face of the first cover 202 and at least one face of the second cover 208. The second oil separation device 104B can be abutted (or interfaced in close proximity) along at least two opposing faces as this component forms a middle of the arrays 300 or 400.

FIG. 7 shows an arrangement where a plate or cover 308 is used to selectively block flow of blow-by gas from particular ports of the first oil separation device 104A and the third oil separation device 104C. The blow-by gas coupling apparatuses 302 can be configured to allow for flow of blow-by gas to or from the array 300. A first end of the blow-by gas coupling apparatuses 302 can be configured to seat against and seal with a respective face of the particular oil separation device 104 where a flow of blow-by gas is desired. The blow-by gas coupling apparatuses 302 are hollow so as to form flow channels that communicate with one or more of the ports previously described. A second end of the blow-by gas coupling apparatuses 302 are configured for coupling to a hose, tube, line or other apparatus that communicates the blow-by gas to or from the engine or other auxiliary component.

Figure 8:
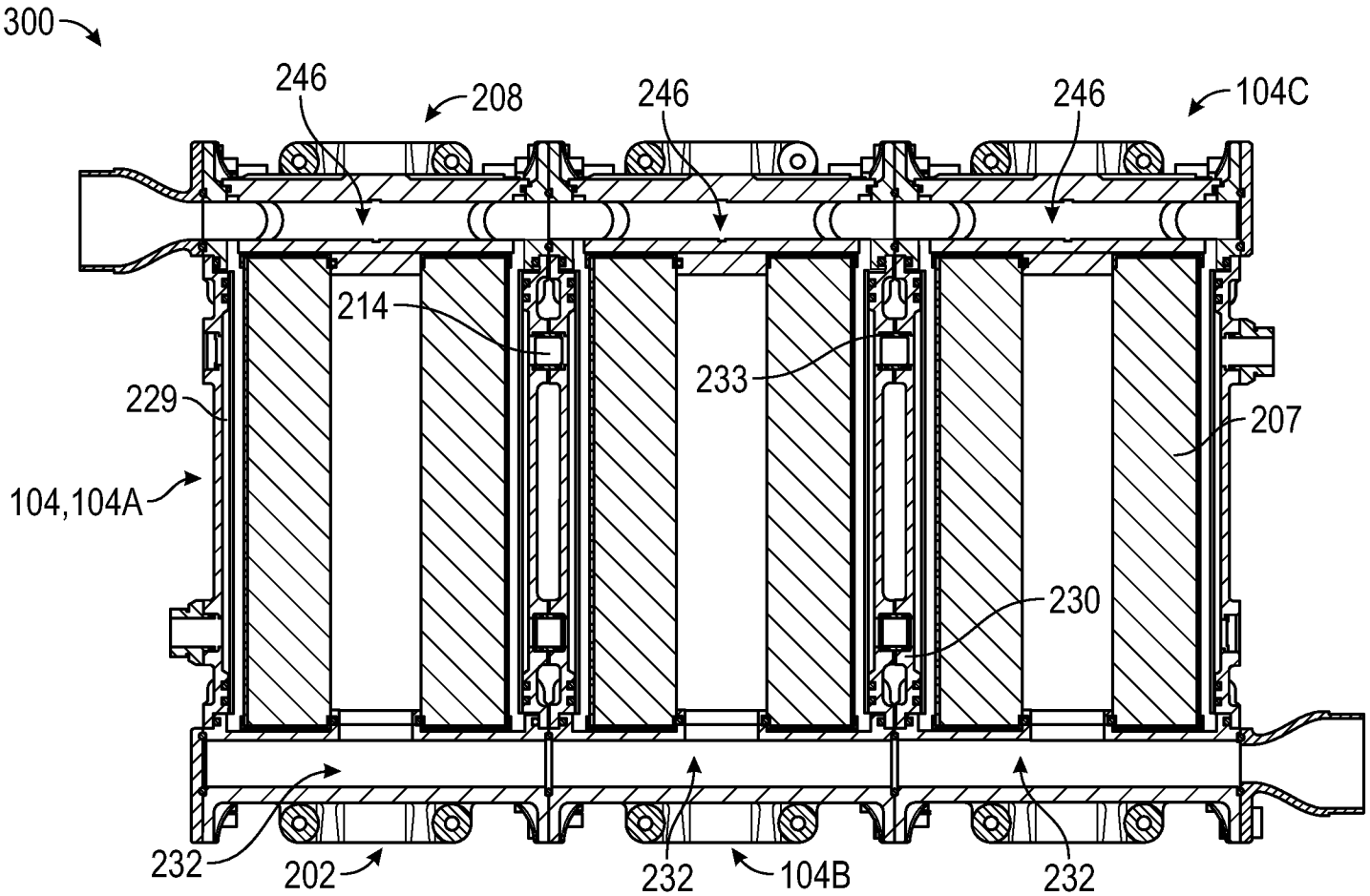
FIG. 8 is a first cross-sectional view of the assembly of the plurality of oil separation devices of FIG. 7.

It is noted in FIG. 7 that the blow-by gas coupling apparatuses 302 may be modified from those shown. As an example, the blow-by gas coupling apparatuses 302 may be made smaller so as to couple only to a single one or two of the plurality of ports along the second faces. Others of these plurality of ports may be selectively blocked so as not to be in fluid communication externally from the oil separation device 104. As another example, the number of the blow-by gas coupling apparatuses 302 can be modified from what is shown in FIG. 7. For example, only one of the oil separation devices 104 such as the second oil separation device 104B may have the blow-by gas coupling apparatuses 302 coupled with the second faces thereof. The first oil separation device 104A and the third oil separation device 104C may not utilize the blow-by gas coupling apparatuses 302 along the second faces thereof. Although three oil separation devices are shown in FIGS. 7 and 8, arrays with relatively less (two) oil separation devices or relatively more (four or more) oil separation devices are contemplated for use together as an array. Thus, the number of oil separation devices shown in purely exemplary with the understanding that the number utilized will be dictated by blow-by gas flow rate capacity of an individual oil separation device 104, the blow-by gas flow rate produced by the engine over its useful life, any dilution air introduced into the crankcase, and other factors.

FIG. 8 shows cross-sectional view of the array 300 of FIG. 7. The individual components of each of the oil separation devices 104A, 104B, 104C have already been described in previous FIGURES, and thus, will not be repeated in great detail.

The cross-section of FIG. 8 illustrates how the first manifold 232 of each first cover 202 can be aligned in fluid communication with one another via ports, passages and other features described previously. The result is the construction of the array 300 has a much larger manifold for receiving blow-by gas, for example. Similarly, the second manifold 246 of each second cover 208 can be combined in fluid communication. Blow-by gas flows can be split passing through the coalescing filters 207.

It should be noted that the flanges 230 (jacket flanges) can be oriented so as to abut or be spaced a small distance from one another. FIG. 8 shows an example where small jumper tubes 233 are utilized. These jumper tubes 233 transfer the fluid from the jacket 229 of the oil separation device 104A to the jacket 229 of the oil separation device 104B or 104C. The jumper tubes 233 are trapped within the ports 214 and have O-rings around the OD at each end to seal the interface Features such as pins can be utilized to facilitate such alignment such that respective ones of the ports 214 align with and communicate with one another. Such alignment can facilitate fluid communication between the jacket 229 of each of the oil separation devices 104A, 104B, 104C. Such arrangement allows for liquid such as engine coolant, engine lube oil or another liquid or fluid to be passed through the oil separation devices 104A, 104B, 104C (and respective jackets 229) sequentially. Jumper tubes 233 can also be utilized to communicate the pressurized fluid from row-to-row, not just device-to-device within a given row. Plugs can selectively be used in lieu of jumper tubes 233 as desired in communication between one jacket 229 to the next is not desired of if sealing the jacket(s) 229 is desired.

Figure 9:
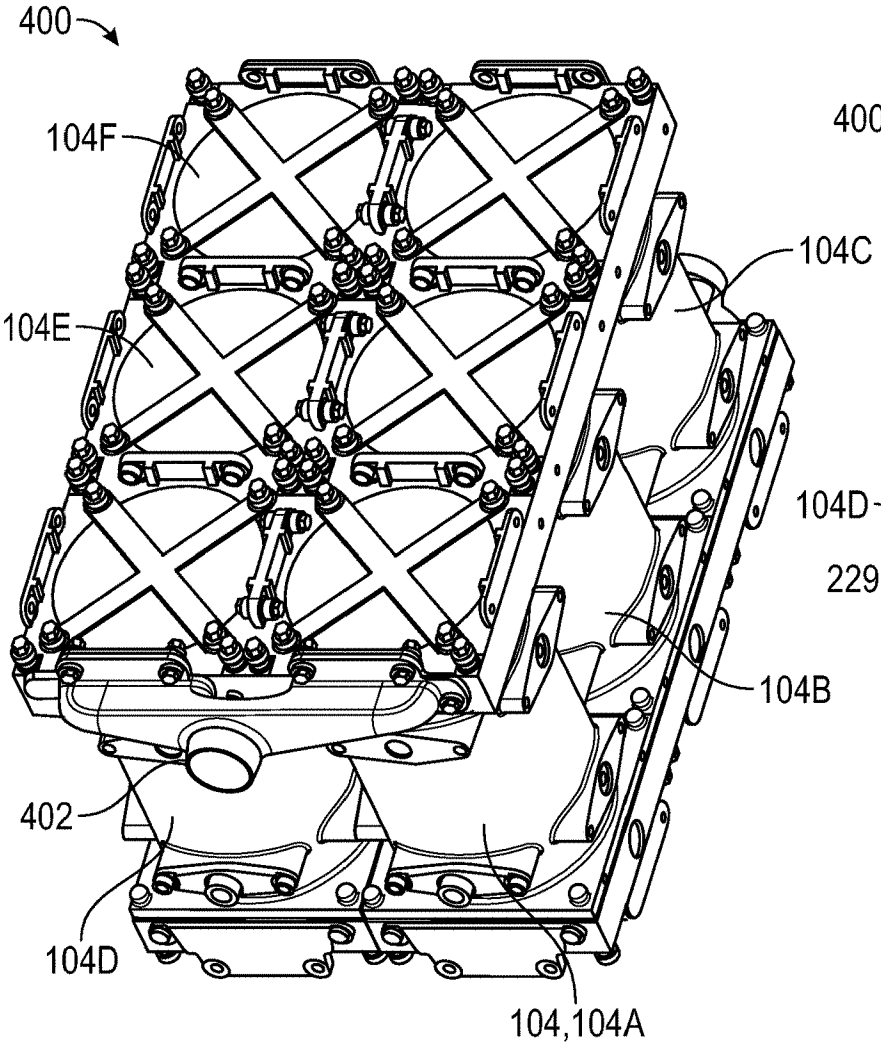
FIG. 9 shows a second assembly of a plurality of oil separation devices arranged in a multi-row array with a first configuration according to one example of the present application.

FIG. 9 shows a double row array 400 of a plurality of the oil separation devices 104 according to a further example. This array has two rows of multiple oil separation devices 104 coupled together. The array 400 can be used in applications having a larger amount of blow-by gas (e.g., from a larger engine) or where blow-by can be used with additional auxiliary components as compared with the array 300 previously discussed. The dual row array 400 can include a first row with the first, second and third oil separation devices 104A, 104B and 104C described previously and a second row with fourth, fifth and sixth oil separation devices 104D, 104E and 104F. The example of FIG. 9 employs only two blow-by gas coupling apparatuses 402. These blow-by gas coupling apparatuses 402 are modified to be larger than those described previously to accommodate multiple flows of blow-by fluid.

Figure 10:
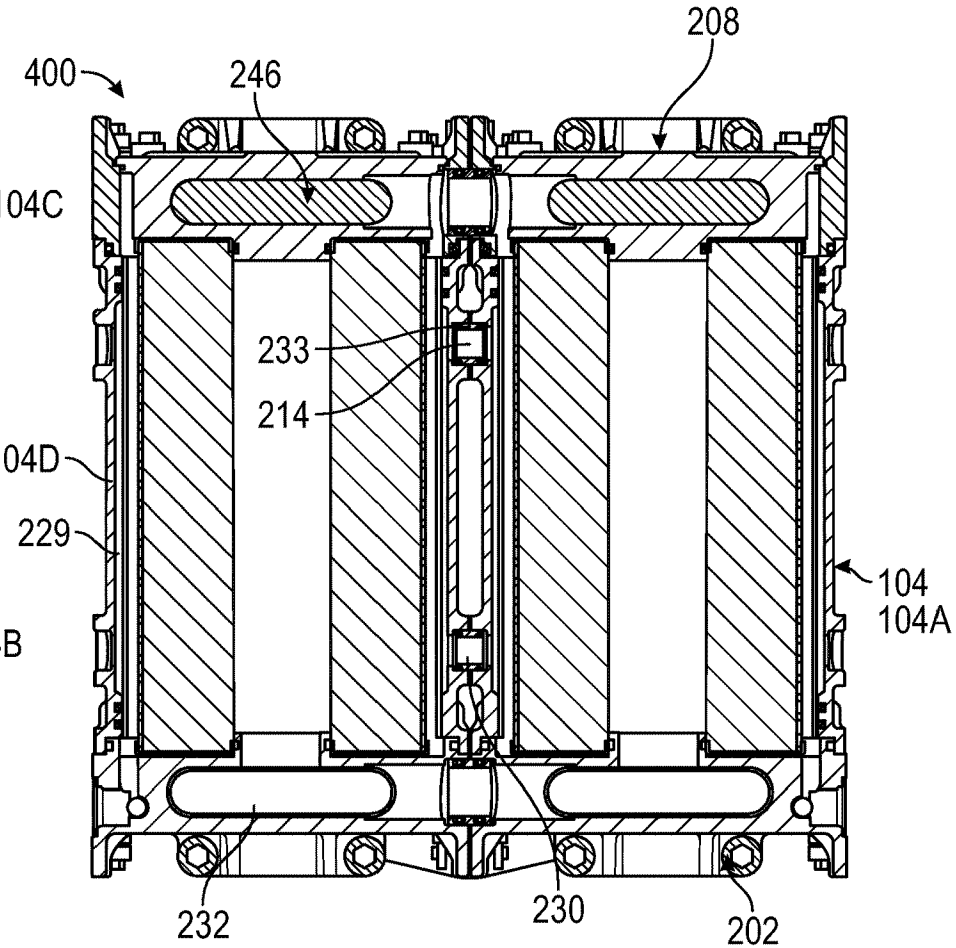
FIG. 10 shows further cross-sectional views of the second assembly of FIG. 9.

FIG. 10 shows a cross-section of the array 400 of FIG. 9. It should be noted in FIG. 10 that the orientation of the first, second and third oil separation devices 104A, 104B and 104C has been modified from those previously shown. In particular, the first, second and third oil separation devices 104A, 104B and 104C are rotated such that the fourth faces of the first and second covers are now on the viewers right. This allows the second faces of the first, second and third oil separation devices 104A, 104B and 104C with the plurality of ports to abut or be spaced a small distance from one another and be in fluid communication with the plurality of ports and the second faces of the fourth, fifth and sixth oil separation devices 104D, 104E and 104F. Such arrangement allows for an even larger fluid communication between the first manifolds 232 across the respective rows (first and second) as well as between the oil separation devices along a particular row. Thus, the combined size of the first manifold 232 and the second manifold 246 of the second covers 208 can be doubled as compared with prior examples. It is however contemplated that communication between rows (or indeed between particular ones of the oil separation devices 104) could be selectively blocked as desired according to further examples. It should be noted that the blow-by fluid interface between oil separation device rows (104A and 104D in FIG. 10) can accomplished by a larger diameter jumper tube with o-rings at each end, for example.

FIG. 10 additionally shows that the flanges 230 (jacket flanges) can be oriented so as to abut or be spaced a small distance from one another as illustrated between the two rows. Respective ones of the ports 214 align with and communicate with one another via the tubes 233 (discussed previously) between the rows (e.g., between the first oil separation device 104A and the fourth oil separation device 104D as shown in FIG. 10). Such alignment can facilitate fluid communication between the jacket 229 of each of the oil separation devices 104A, 104B, 104C, 104D, 104E and 104F. Such arrangement allows for fluid such as pressurized engine boost air, engine coolant, or engine lube oil to be passed through the oil separation devices 104A, 104B, 104C, 104D, 104E and 104F (and respective jackets 229).

Additionally, the oil separation devices and arrays discussed herein can include internal pressure regulators and other systems and components as discussed in U.S. patent Ser. Nos. 18/092,547, 18/092,502 and 18/092,525, filed on Jan. 3, 2023, the entire contents of each of which is incorporated herein by reference in their entirety.

INDUSTRIAL APPLICABILITY

In operation, the engine 100 can be configured to combust fuel to generate power. While typically efficient, a small portion of the combustion gases may escape the combustion chamber past the piston as blow-by and enter undesirable areas of the engine 100 such as the crankcase. The present disclosure contemplates systems 102, 102', and 102" including one or more oil separation devices 104 to filter oil to remove the oil from the blow-by gas.

Oil separation devices containing coalescing filters are known, however, these have disadvantages. These devices typically lack cold climate capability, they lack robustness to high heat environments, and/or they lack vibration robustness. For example, in a cold climate water vapor can condense out and/or freeze within the oil separation device. This condensed and/or frozen water vapor can restrict flow of blow-by gas through the filter, which can lead to unwanted pressure spikes within the engine. The present application recognizes a construction for the oil separation devices 104 that utilizes the jacket 229 to cool, maintain, and/or warm the filter of the oil separation devices 104 at a desired temperature range. As an example, the oil separation device 104 with the jacket 229 can be pre-heated prior to engine startup and heated during engine operation with on-engine liquid (e.g., engine lube oil, jacket water, etc.) or an off-engine fluid. This improves operation of the filter in cold climate as condensed water vapor and/or frozen water vapor that restricts flow can be avoided. The design of the oil separation devices 104 can have improved temperature and vibration robustness. Thus, the present oil separation devices 104 can be configured to reduce or prevent heat loss, water condensate, oil/water emulsion, and/or freezing.

Additionally, the use of on engine liquid such as coolant (e.g., jacket water) or lube oil for the jacket 229 can leverage existing engine liquid sources. Dedicated engine components to cool, maintain, and/or warm the filter of the oil separation devices 104 to the desired temperature range need not be created. Furthermore, the on engine liquid can already be maintained at the desired temperature range suitable for use with maintaining the filter (and hence, the blow-by gas) above a dew point of the water vapor in the temperature of the blow-by gas and below a temperature at which one or more components of the oil separating apparatus become inoperable. Use of on engine liquid (and indeed off engine liquid), which is already at the desired temperature range for the jacket 229 can avoid complexity of regulating and mixing compressed air with cooled air from the after-cooler to achieve a desired temperature range.

Additionally, oil separation devices known in the art are often purpose-built solutions. As such, these devices do not offer the configurability, commonality, scalability and modularity needed to address a wide range of multi-displacement and different power density engine platforms. The present oil separation devices 104 can be configurable as assemblies such as arrays 300 or 400. This modularity (the desired number of oil separation devices can be easily selected and implemented together as an array) can provide for the configurability, commonality, scalability and modularity needed to address various engine platforms. The assemblies described can be easily constructed to handle various volumes of blow-by gas and other fluids as desired for various engine and/or auxiliary component needs.

Thus, the present oil separation devices and systems and methods of use can maintain common inlet and/or outlet covers and manifolds with a wide variety of coalescing filter lengths (the central housing between the inlet and outlet covers can be removed and replaced with different length as desired). Additionally, the configuration of the inlet and/or outlet covers having ports/passages on each of four faces (or even three of four faces) allows for various system configurations (multi-row parallel arrays, multi-row series arrays, U-shaped arrays, L-shape arrays, T-shaped arrays, H-shaped arrays, single row arrays, etc.). Similarly, oil drain manifolding on each of four faces (or indeed even on three or two of four faces) of the inlet or outlet covers can allow for collection and draining of oil in directions as desired. Similarly, draining from a bottom of the inlet or outlet cover is also disclosed. The outer housing 204 can also include ports that can be used to communicate with the jacket 229 as discussed herein. These ports can be located along multiple sides/faces (e.g., corresponding to the four faces of the inlet and/or outlet covers, for example). This can allow for supplemental energy fluid to be supplied between the oil separation devices in various directions as desired. The configuration of the inlet and/or outlet covers having ports/passages on each of four faces (or even three of four faces) minimizes or eliminates the need for piping, lines or other communication mechanisms between the oil separation devices of the system. Put another way, the configuration of the oil separation devices allows for them to be placed in close proximity (e.g., abutting or spaced a small distance) communicating with one another as desired and allows for blow-by, oil drain, supplemental energy to the jacket to be communicated between the oil separation devices as desired.

The above detailed description is intended to be illustrative, and not restrictive. The scope of the disclosure should, therefore, be determined with references to the appended claims, along with the full scope of equivalents to which such claims are entitled.

What is claimed is:

1. An engine system comprising:

a crankcase of an engine having a blow-by gas passing therethrough;

a liquid source containing a liquid; and an oil separating apparatus in fluid communication with the blow-by gas and having a coalescing filter to separate oil from the blow-by gas, wherein separate from the blow-by gas and the coalescing filter, the oil separating apparatus is in fluid communication with the liquid source to receive the liquid, wherein the liquid is passed through the oil separating apparatus in a heat exchange relationship with the blow-by gas to maintain a desired temperature range for the blow-by gas.

2. The engine system of claim 1, wherein the desired temperature range is between about 70 degrees Celsius and 90 degrees Celsius.

3. The engine system of claim 1, wherein the liquid source is located on the engine and comprises one of engine lube oil or engine jacket water.

4. The engine system of claim 1, wherein the liquid source is located off the engine.

5. The engine system of claim 1, wherein the desired temperature range is above a dew point temperature of the blow-by gas and below a temperature at which one or more components of the oil separating apparatus become inoperable.

6. The engine system of claim 1, wherein the liquid source is an oil sump of the engine and the liquid is engine lube oil, and wherein both the oil separated by the coalescing filter from the blow-by gas and the engine lube oil are returned to the oil sump from the oil separating apparatus.

7. The engine system of claim 6, wherein the engine lube oil is unregulated when passing to the oil sump from the oil separating apparatus while the oil separated by the coalescing filter from the blow-by gas is regulated by a valve when passing to the oil sump from the oil separating apparatus.

8. The engine system of claim 1, further comprising a jet pump in fluid communication with both the blow-by gas after leaving the oil separating apparatus and a boost air of the engine that bypasses the oil separating apparatus, wherein the jet pump is configured to combine the blow-by gas and the boost air.

9. The engine system of claim 8, wherein the boost air is engine air that is a mixture of compressed air and cooled air.

10. The engine system of claim 9, wherein the blow-by gas after leaving the oil separating apparatus is routed to a suction port of the jet pump, and wherein the boost air is routed to an inlet port of the jet pump.

11. A method of maintaining blow-by gas from a crankcase of an engine within a desired temperature range when passing through an oil separating apparatus, the method comprising:

passing the blow-by gas from the crankcase to the oil separating apparatus;

supplying a liquid from a liquid source through the oil separating apparatus, wherein within the oil separating apparatus the liquid is in a heat transfer relationship with the blow-by gas passing through the oil separating apparatus and maintains the blow-by gas at a desired temperature range;

separating oil from the blow-by gas with the oil separating apparatus;

passing the oil separated by the oil separating apparatus to the crankcase; and returning the liquid to the liquid source.

12. The method of claim 11, wherein the desired temperature range is between about 70 degrees Celsius and 90 degrees Celsius.

13. The method of claim 11, wherein the supplying the liquid includes supplying one of engine coolant or engine lube oil to a jacket of the oil separating apparatus that surrounds and is sealed from a coalescing filter that performs the separating the oil from the blow-by gas.

14. The method of claim 11, wherein the liquid source is located one of: on the engine or off the engine.

15. The method of claim 11, wherein returning the liquid to the liquid source includes returning engine lube oil to an oil sump of the engine, wherein both the oil separated by the oil separating apparatus from the blow-by gas and the engine lube oil are returned to the oil sump from the oil separating apparatus.

16. The method of claim 15, further comprising regulating at least the oil separated by the oil separating apparatus from the blow-by gas that passes from the oil separating apparatus to the oil sump.

17. The method of claim 11, further comprising:

passing a boost air from the engine directly to an inlet of a jet pump bypassing the oil separating apparatus;

regulating the blow-by gas after passing through the oil separating apparatus; and combining the blow-by gas after passing through the oil separating apparatus with the boost air by passing both the boost air and the blow-by gas through the jet pump.

18. An engine comprising:

a crankcase having a blow-by gas passing therethrough;

an on engine liquid source containing one of engine coolant or engine lube oil heated prior to startup of the engine to a first desired temperature range; and an oil separating apparatus in fluid communication with the blow-by gas and having a coalescing filter to separate oil from the blow-by gas, wherein separate from the blow-by gas and the coalescing filter, the oil separating apparatus is in fluid communication with the liquid source to receive the one of engine coolant or engine lube oil, wherein the one of engine coolant or engine lube oil is passed through the oil separating apparatus in a heat exchange relationship with the blow-by gas to maintain a second desired temperature range for the blow-by gas.

19. The engine of claim 18, wherein the first desired temperature range is between about 70 degrees Celsius and 90 degrees Celsius and the second desired temperature range is above a dew point temperature of the blow-by gas and below a temperature at which one or more components of the oil separating apparatus become inoperable.

20. The engine of claim 18, wherein the liquid source is an oil sump of the engine and the engine lube oil and the oil separated by the coalescing filter from the blow-by gas are returned to the oil sump from the oil separating apparatus, wherein the engine lube oil is unregulated when passing to the oil sump from the oil separating apparatus while the oil separated by the coalescing filter from the blow-by gas is regulated by a valve when passing to the oil sump from the oil separating apparatus.

* * * * *